US007139517B2

(12) United States Patent
Enoki et al.

(10) Patent No.: US 7,139,517 B2
(45) **Date of Patent: *Nov. 21, 2006**

(54) DEVELOPING METHOD FOR AN IMAGE FORMING APPARATUS AND DEVELOPING DEVICE USING THE SAME

(75) Inventors: Shigekazu Enoki, Kanagawa (JP); Takayuki Maruta, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/178,488

(22) Filed: Jul. 12, 2005

(65) Prior Publication Data

US 2005/0271427 A1 Dec. 8, 2005

Related U.S. Application Data

(62) Division of application No. 10/322,600, filed on Dec. 19, 2002, now Pat. No. 7,027,760.

(30) Foreign Application Priority Data

Dec. 20, 2001 (JP) ..... 2001-387693
Dec. 28, 2001 (JP) ..... 2001-401375

(51) Int. Cl.
*G03G 15/09* (2006.01)

(52) U.S. Cl. ..... 399/267; 399/277; 430/122

(58) Field of Classification Search ..... 399/252, 399/267, 270, 277; 430/108.8, 109.4, 122
See application file for complete search history.

(56) References Cited

U.S. PATENT DOCUMENTS 4,679,527 A 7/1987 Chang
5,001,517 A 3/1991 Hosaka et al.
5,030,996 A * 7/1991 Tajima et al. ..... 399/232
5,066,558 A * 11/1991 Hikake et al. ..... 430/108.7
5,202,730 A * 4/1993 Fuji et al. ..... 399/270
5,430,528 A 7/1995 Kumasaka et al.
5,574,545 A * 11/1996 Hosoi et al. ..... 399/270

(Continued)

FOREIGN PATENT DOCUMENTS

EP 519396 A1 * 12/1992

(Continued)

OTHER PUBLICATIONS

Patent Abstracts of Japan, JP 7-140730, Jun. 2, 1995.

*Primary Examiner*—Robert Beatty
(74) *Attorney, Agent, or Firm*—Oblon, Spivak, McClelland, Maier & Neustadt, P.C.

(57) ABSTRACT

A developing method of the present invention develops a latent image formed on an image carrier with a two-ingredient type developer, which consists of toner grains and carrier grains retaining the toner grains thereon, deposited on a developer carrier in the form of brush chains. Assume that the brush chains on the developer carrier has a height of h as measured at a zero field point where the magnetic field formed by a main magnet is zero, and that a gap for development that is the shortest distance between the developer carrier and the image carrier is a, then a and h are equal to each other. Image quality is estimated by varying the combination of an angle θ between the gap and the zero field point, the outside diameter of the image carrier and the outside diameter of the developer carrier and the height h. A desirable or an optimum range of the results of estimation are selected to set various conditions.

46 Claims, 19 Drawing Sheets

U.S. PATENT DOCUMENTS

| | | | | |
|---|---|---|---|---|
| 5,729,805 | A * | 3/1998 | Chiba et al. | 399/276 |
| 5,828,936 | A | 10/1998 | Shimizu et al. | |
| 6,081,684 | A | 6/2000 | Naganuma et al. | |
| 6,083,655 | A | 7/2000 | Itabashi et al. | |
| 6,473,586 | B1 | 10/2002 | Noda et al. | |
| 6,708,015 | B1 | 3/2004 | Kurosu et al. | |
| 6,760,561 | B1 | 7/2004 | Kurosu | |

FOREIGN PATENT DOCUMENTS

| | | | |
|---|---|---|---|
| EP | 0 864 930 | | 9/1998 |
| JP | 62-075683 | | 4/1987 |
| JP | 62-075687 | | 4/1987 |
| JP | 63-061272 | | 3/1988 |
| JP | 05-034966 | | 2/1993 |
| JP | 5-289522 | | 11/1993 |
| JP | 06-019204 | | 1/1994 |
| JP | 7-128981 | | 5/1995 |
| JP | 7-117769 | | 12/1995 |
| JP | 10-020632 | | 1/1998 |
| JP | 10-073996 | | 3/1998 |
| JP | 10-133449 | | 5/1998 |
| JP | 10-171204 | | 6/1998 |
| JP | 2829927 | | 9/1998 |
| JP | 11-084716 | | 3/1999 |
| JP | 11-109755 | A | 4/1999 |
| JP | 2000-321814 | | 11/2000 |
| JP | 2001042571 | A * | 2/2001 |
| JP | 2001-324874 | | 11/2001 |
| JP | 2002-258618 | | 9/2002 |
| JP | 2002-278263 | | 9/2002 |
| JP | 2002-278264 | | 9/2002 |

* cited by examiner

FIG. 4

| | $\phi$ dev | 18 | | | 30 | | |
|---|---|---|---|---|---|---|---|
| h=PG | $\theta$ \ $\phi$ pc | 30 | 90 | BELT | 30 | 90 | BELT |
| 0.3 | 15 | × | × | × | ○ | ○ | ○ |
| | 30 | ○ | ○ | ○ | × | ○ | ○ |
| | 45 | × | ○ | ○ | × | × | × |
| 0.6 | 15 | ○ | ○ | ○ | ○ | ○ | ○ |
| | 30 | ○ | ○ | ○ | × | ○ | ○ |
| | 45 | × | ○ | ○ | × | × | × |
| 0.9 | 15 | ○ | × | × | ○ | ○ | ○ |
| | 30 | ○ | ○ | ○ | × | ○ | ○ |
| | 45 | × | ○ | ○ | × | × | × |

FIG. 5

| | $\phi$ dev | 18 | | | 30 | | |
|---|---|---|---|---|---|---|---|
| h=PG | $\theta$ \ $\phi$ pc | 30 | 90 | BELT | 30 | 90 | BELT |
| 0.3 | 15 | 0.789 | 0.667 | 0.607 | 1.322 | 0.979 | 0.811 |
| | 30 | 2.197 | 1.731 | 1.506 | 4.319 | 2.939 | 2.31 |
| | 45 | 4.353 | 3.388 | 2.936 | 9.087 | 5.961 | 4.693 |
| 0.6 | 15 | 1.089 | 0.967 | 0.907 | 1.622 | 1.279 | 1.111 |
| | 30 | 2.497 | 2.031 | 1.806 | 4.619 | 3.239 | 2.61 |
| | 45 | 4.651 | 3.688 | 3.236 | 9.387 | 6.261 | 4.993 |
| 0.9 | 15 | 1.389 | 1.267 | 1.207 | 1.922 | 1.579 | 1.411 |
| | 30 | 2.797 | 2.331 | 2.106 | 4.919 | 3.539 | 2.91 |
| | 45 | 4.953 | 3.988 | 3.536 | 9.687 | 6.561 | 5.293 |

FIG. 7

| | $\phi$ dev | 18 | | | 30 | | |
|---|---|---|---|---|---|---|---|
| h=PG | $\theta$ \ $\phi$ pc | 30 | 90 | BELT | 30 | 90 | BELT |
| 0.3 | 15 | 1.32 | 1.11 | 1.01 | 2.20 | 1.63 | 1.35 |
| | 30 | 3.66 | 2.89 | 2.51 | 7.20 | 4.90 | 3.85 |
| | 45 | 7.26 | 5.65 | 4.89 | 15.15 | 9.94 | 7.82 |
| 0.6 | 15 | 1.82 | 1.61 | 1.51 | 2.70 | 2.13 | 1.85 |
| | 30 | 4.16 | 3.39 | 3.01 | 7.70 | 5.40 | 4.35 |
| | 45 | 7.75 | 6.15 | 5.39 | 15.65 | 10.44 | 8.32 |
| 0.9 | 15 | 1.54 | 1.41 | 1.34 | 2.14 | 1.75 | 1.57 |
| | 30 | 3.11 | 2.59 | 2.34 | 5.47 | 3.93 | 3.23 |
| | 45 | 5.50 | 4.43 | 3.93 | 10.76 | 7.29 | 5.88 |

DEVELOPING METHOD FOR AN IMAGE FORMING APPARATUS AND DEVELOPING DEVICE USING THE SAME

CROSS-REFERENCE TO RELATED APPLICATIONS

This application is a divisional of U.S. application Ser. No. 10/322,600, filed Dec. 19, 2002 now U.S. Pat. No. 7,027,760, and is based upon and claims the benefit of priority from the prior Japanese Patent Application No. 2001-387693, filed Dec. 20, 2001, and Japanese Patent Application No. 2001-401375, filed Dec. 28, 2001, the entire contents of each of which are hereby incorporated herein by reference.

BACKGROUND OF THE INVENTION

1. Field of the Invention

The present invention relates to a copier, facsimile apparatus, printer or similar electrophotographic image forming apparatus. More particularly, the present invention relates to a magnetic brush type developing method using a two-ingredient type developer made up of toner grains and carrier grains, and a developing device using the same.

2. Description of the Background Art

It is a common practice with an electrophotographic imager forming apparatus to form a latent image on an image carrier, which has a photoconductive layer on its surface, and develop the latent image with a developing device facing the image carrier to thereby produce a corresponding toner image. The developing device stores a developer that is often implemented as a two-ingredient type developer made up of toner grains and magnetic carrier grains and feasible for color image formation. This type of developer is frictionally charged by an agitator disposed in the developing device, so that the toner grains electrostatically deposit on the carrier grains. The carrier grains with the toner grains are conveyed on a sleeve or developer carrier, which is in rotation, by being magnetically retained on the sleeve by magnets arranged inside the sleeve.

One of the magnets disposed in the sleeve is a main magnet for development located at a position where the sleeve and image carrier are closest to each other. When the developer on the sleeve in rotation approaches the main magnet, the carrier grains of the developer gather and rise along the magnetic lines of force of the main magnet, forming a magnet brush having a number of brush chains.

As for a developing system-of the type using the magnet brush, the carrier grains, which are dielectric, are considered to increase field strength between the image carrier and the sleeve and allow the toner grains to migrate from the tips of the brush chains toward the image carrier. In this type of developing system, the toner grains in the portion where the magnet brush formed by the carrier grains is absent has been used for development little. It has therefore been extremely difficult to increase the amount of toner to contribute to development in relation to the adjustment of the other conditions.

To implement high image density despite the limited region where the toner grains are usable, Japanese Patent No. 2,668,781, for example, discloses a developing method that uses an alternating electric field in order to use both of toner grains deposited on brush chains, which are formed by magnetic grains, and toner grains deposited on a developer carrier. This kind of scheme, however, cannot use toner grains other than toner grains deposited on the brush chains and developer carrier in a developing zone where the magnetic grains rub against an image carrier. It is therefore difficult to implement sufficient image quality. Further, the number of brush chains available with the magnetic grains is too small to realize, based on an electrode effect, a high-quality image with a smooth solid portion.

To enhance the contribution of toner grains to development, it is necessary to increase the ratio in which toner grains are used in a developing region. In practice, however, field strength varies in a complicated way in relation to a gap for development, which is the shortest distance between an image carrier and a sleeve, and the curvature of the image carrier, often failing to cause the toner grains to fly toward the image carrier. It is therefore extremely difficult to optimize the positional relation between the image carrier and the sleeve. This is particularly true when the image carrier has a small diameter, because a space between the image carrier and the sleeve sharply decreases toward the gap for development.

A current trend in the electrophotographic imaging art is toward color image formation as distinguished from monochromatic image formation. Generally, to fix a toner image formed by dry toner grains on a sheet or recording medium, use is made of a contact type, thermal fixing method that heats a roller, belt or similar fixing member. This type of fixing method has thermal efficiency high enough to implement high-speed fixation and can provide color toner with gloss and transparency. However, the problem with such a fixing scheme is that when the toner grains are pressed against the fixing member in a melted state and then peeled off, part of the toner image is transferred to the fixing member and then to another toner image to follow. This is generally referred to as toner offset.

To obviate toner offset, it has been customary to use, e.g., a fixing roller formed of silicone rubber or fluorocarbon resin desirable in parting ability, and to coat the surface of the roller with silicone oil or similar parting oil. Although the parting oil is successful to obviate toner offset, it must be accompanied by a coating device that increases the size and cost of a fixing device.

In light of the above, as for monochromatic toner, it has been proposed to adjust, e.g., the molecular weight distribution of binder resin in such a manner as to increase viscoelasticity when the toner melts, thereby preventing the melted toner from breaking. It has also been proposed to add wax or similar parting agent to the toner. These proposals are directed to the omission or the minimization of the parting oil to be coated on the fixing roller.

The parting agent added to the toner is undesirable in that it increases the adhesion of the toner and thereby obstructs the transfer of the toner to a sheet. Moreover, the parting agent contained in the toner smears a carrier or similar frictional charging member and thereby degrades the charging ability of the charging member, lowering durability.

Japanese Patent Laid-Open Publication No. 8-220808, for example, teaches toner formed of linear polyester resin with a softening point of 90° C. to 120° C. and carnauba wax. Japanese Patent Laid-Open Publication No. 9-106105 teaches toner formed of resin and wax soluble in each other, but different in softening point. Japanese Patent Laid-Open Publication No. 9-304964 teaches toner defining the melting viscosity of polyester resin and that of wax specifically. Japanese Patent Laid-Open Publication No. 10-293425 teaches toner containing polyester resin with a softening point of 90° C. to 120° C. and rice wax, carnauba wax and silicone oil. Further, Japanese Patent Laid-Open Publication No. 5-612242 teaches polymerized toner containing wax.

The conventional magnet brush type developing method cannot easily implement sufficient image density or a smooth solid portion, as stated earlier. In addition, the toner containing a parting agent relatively easily coheres and is therefore low in developing ability and dot reproducibility. It is therefore difficult to realize high-quality images with this kind of toner.

More specifically, wax appears on the surfaces of toner grains containing a parting agent in order to obviate offset, aggravating cohesion of the toner grains. Generally, additives are added to toner in consideration of electrification, image transfer, toner scattering, toner spent and so forth. However, the expected effect is difficult to achieve with the toner containing a parting agent for a given amount of additives.

If a parting oil coating device can be omitted from the fixing device, then there can be realized cost reduction and simple construction. However, it is difficult to achieve high image quality with the conventional magnet brush type developing device, which uses toner containing a parting agent, because the parting agent lowers the developing ability and dot reproducibility.

Technologies relating to the present invention are also disclosed in, e.g., Japanese Patent No. 2,829,927, Japanese Patent Publication No. 7-117769, and Japanese Patent Laid-Open Publication Nos. 5-289522, 7-128981, 10-73996, 2000-321814, 2001-324874, 2002-258618, 2002-278263, and 2002-278264.

SUMMARY OF THE INVENTION

It is a first object of the present invention to provide a developing method capable of promoting the contribution of toner to development without regard to the diameter of an image carrier to thereby realize a high-quality image with a dense, smooth solid portion, a developing device using the same, and an image forming apparatus including the developing device.

It is a second object of the present invention to provide a developing device capable of promoting the contribution of toner to development to thereby realize a dense, smooth solid image and faithful dot reproduction even when the toner contains a parting agent, a developing device using the same, and an image forming apparatus including the developing device.

A developing method of the present invention develops a latent image formed on an image carrier with a magnet brush by depositing a two-ingredient type developer, which consists of toner grains and carrier grains retaining the toner grains thereon, on a developer carrier facing the image carrier and accommodating magnets thereinside. Assume that a brush chain formed by the developer on the developer carrier has a height of h as measured at a zero field point where a magnetic field of, among the magnets, a main magnet for development is zero, and that a gap for development that is the shortest distance between the developer carrier and the image carrier is a, then a and h are equal to each other. Image quality is estimated by varying the combination of an angle θ between the gap and the zero field point, the outside diameter of the image carrier and the outside diameter of the developer carrier and the height h. A desirable or an optimum range of the results of estimation are selected to set various conditions.

BRIEF DESCRIPTION OF THE DRAWINGS

The above and other objects, features and advantages of the present invention will become more apparent from the following detailed description taken with the accompanying drawings in which:

FIG. 4 is a table listing the results of image quality estimation relating to image density and granularity;

FIG. 5 is a table showing actually measured distances from the zero field point of the developer carrier to the image carrier in correspondence to the estimated values of FIG. 4;

FIG. 7 is a table listing ratios of the height of brush chains to the distance from the zero field point to the image carrier in correspondence to the estimated values of FIG. 4;

DESCRIPTION OF THE PREFERRED EMBODIMENTS

Figure 1:
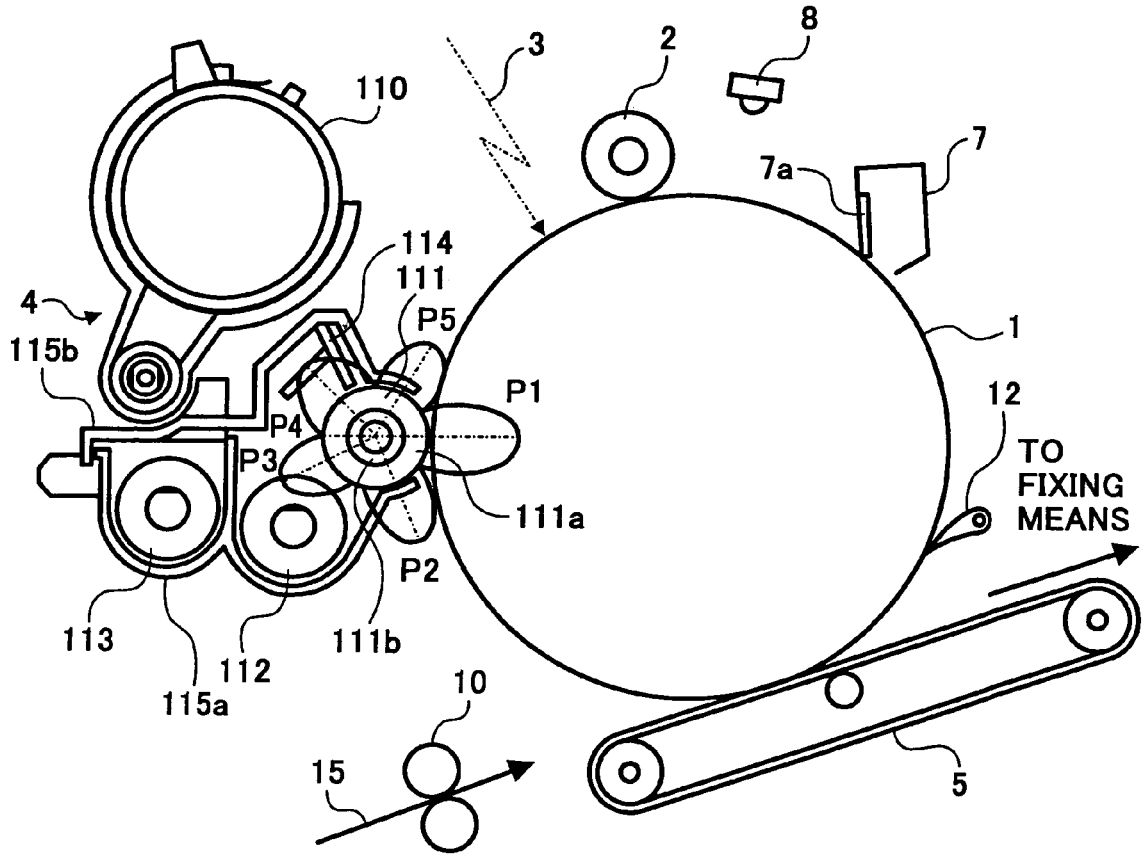
FIG. 1 is a fragmentary view showing an image forming apparatus to which the present invention is applied.

Preferred embodiments of the present invention will be described hereinafter.

First Embodiment

A first embodiment of the present invention is directed toward the first object stated earlier. First, reference will be made to FIG. 1 for describing an image forming apparatus to which the illustrative embodiment is applied and implemented as a copier by way of example. As shown, the copier includes a photoconductive drum 1, which is a specific form of an image carrier. Sequentially arranged around the drum in the counterclockwise direction are a charger roller or charging means 2, exposing means, not shown, a developing device 4, an image transfer belt 5, cleaning means 7, and discharging means 8.

The charge roller 2 uniformly charges the surface of the drum 1. The exposing means scans the charged surface of the drum 1 with a laser beam 3 in accordance with image data representative of a document image, thereby forming a latent image on the drum 1. The developing device 4 develops the latent image with toner to thereby produce a corresponding toner image. The toner image is transferred from the drum 1 to a sheet or recording medium 15 being conveyed by the image transfer belt 5. The cleaning means 7 removes toner left on the drum 1 after the image transfer. The discharger 8 discharges the surface of the drum 1 cleaned by the cleaning means 7.

More specifically, a power supply, not shown, applies a bias to the charge roller 2 held in contact with the drum 1, so that the surface of the drum 1 is uniformly charged. The laser beam 3 is emitted from a laser diode, not shown, included in the exposing means and then steered by a polygonal mirror, not shown, to be incident on the drum 1. A power supply, not shown, applies a bias to the image transfer belt 5 in order to electrostatically transfer the toner image from the drum 1 to the sheet 15.

The sheet 15 is fed from sheet feeding means, not shown, to a registration roller pair 10. The registration roller pair 10 once stops the sheet 15 for correcting its skew and then conveys the sheet 15 toward a nip between the image transfer belt 5 and the drum 1 at preselected timing. A peeler 12 peels off the sheet 15 electrostatically adhered to the drum 1 at the time of image transfer.

The image transfer belt 5 conveys the sheet 15 carrying the toner image thereon to fixing means, not shown, located downstream of the drum 1 in the direction of sheet conveyance. The fixing means fixes the toner image on the sheet 15 with heat and pressure. Cleaning means 7 removes toner left on the drum 1 after the image transfer with a blade 7*a*. Subsequently, the discharger 8 discharges, or initializes, the surface of the drum 1 to thereby prepare it for the next image forming cycle.

The developing device 4 includes a developing roller or developer carrier 111 that faces the drum 1 to form a developing zone therebetween. The developing roller 111 is made up of a sleeve 111*a* and a magnet roller or magnetic field generating means 111*b* accommodated in the sleeve 111*a*. The sleeve 111*a* is formed of aluminum, brass, stainless steel, conductive resin or similar nonmagnetic material and caused to rotate clockwise by a mechanism not shown.

A lower casing 115*a*, forming part of the developing device 4, is partitioned into two chambers respectively accommodating screw conveyors 112 and 113. The screw conveyors 112 and 113 convey a toner and carrier mixture or two-ingredient type developer while agitating it, so that the developer is circulated in the lower casing 115*a*. The developer is then deposited on the sleeve 111*a* at the screw conveyor 112 side. A doctor blade or metering member 114 is affixed to an upper casing 115*b* for metering the developer deposited on the sleeve 111*a*, so that the developer forms a layer with uniform thickness on the sleeve 111*a*.

A toner bottle or toner replenishing member 110 is positioned above the screw conveyor 113 and packed with fresh toner. When a toner content sensor, not shown, determines that the toner content of the developer is short, the fresh toner is replenished from the toner bottle 110 to the developing device 4.

The magnet roller 111*b* includes a plurality of magnets, i.e., five magnets in the illustrative embodiment positioned at intervals in the circumferential direction of the sleeve 11*a*. The magnets include a main magnet constituting a main pole that forms a magnetic line of force P1 for causing the developer to rise on the sleeve 111*a* in the form of a magnet brush in the developing zone. Another magnet forms a magnetic line of force P3 for scooping up the developer onto the sleeve 111*a*. Two other magnets respectively form magnetic lines of force P4 and P5 for conveying the developer deposited on the sleeve 111*a* to the developing zone. Still another magnetic forms a magnetic line of force P2 for conveying the developer in the zone following the developing zone.

The drum 1 and developing device 4 are mounted on a single casing or process cartridge, not shown, removable from the copier body not shown.

Figure 2:
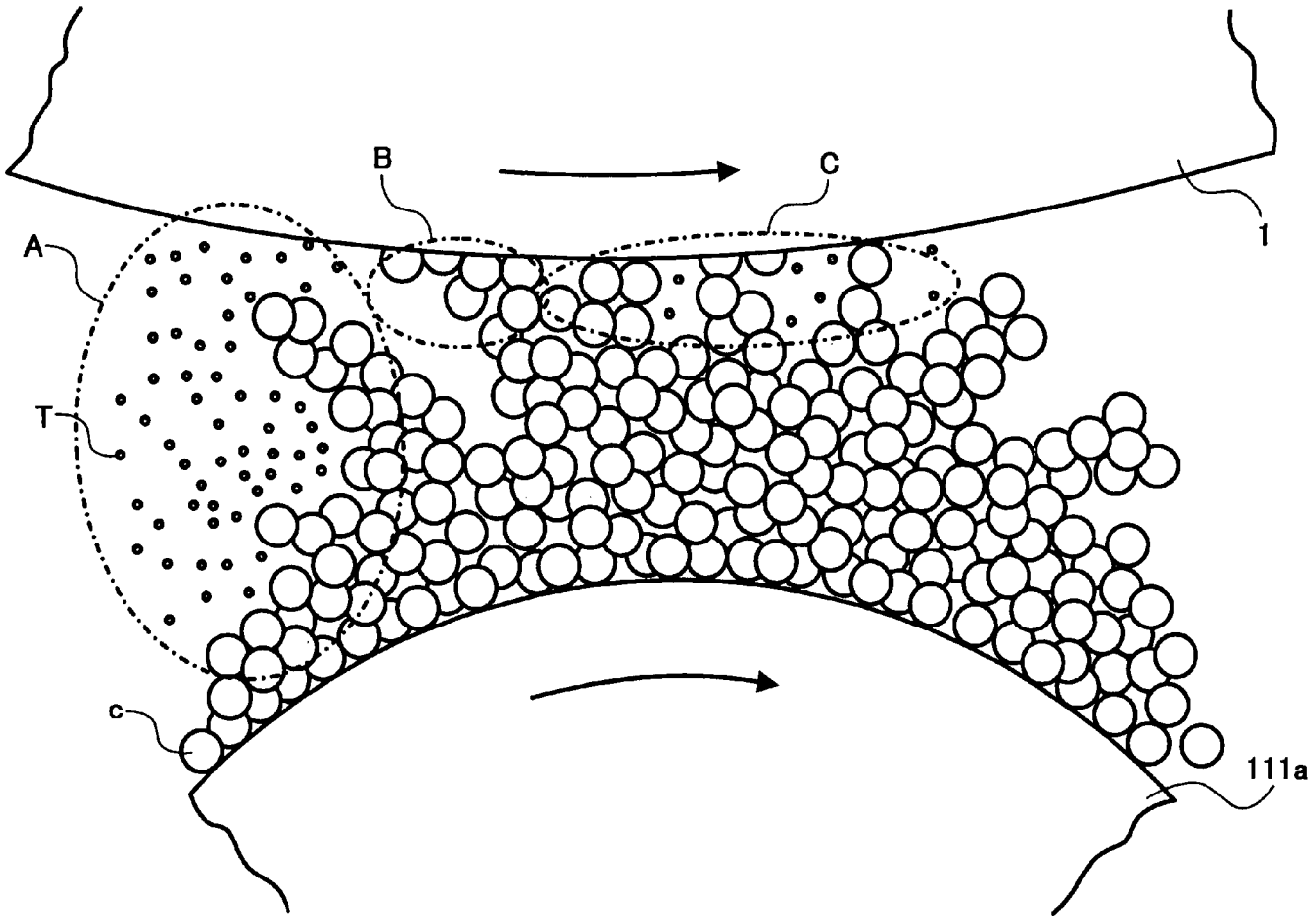
FIG. 2 is a sketch demonstrating the behavior of a two-ingredient type developer observed in a developing zone included in a developing device, which forms part of the apparatus of FIG. 1.

FIG. 2 is a sketch demonstrating the behavior of the developer. The developing zone refers to a zone where toner grains T included in the developer move toward the drum 1 for development without regard to whether magnetic carrier grains c also included in the developer, gather to form a magnet brush or whether the thin developer layer is formed on the sleeve 111*a*. More specifically, as shown in FIG. 2, the developing zone is made up of a fore portion, a middle portion and a hind portion surrounded by lines A, B and C, respectively. In the fore portion A, the carrier grains c of the developer approached the main pole, FIG. 1, gather to form brush chains with the toner grains T deposited thereon and then start rising along the magnetic line of force P1. Subsequently, in the middle portion B and hind portion C, the brush chains formed by the carrier grains c sequentially contact the drum 1 in accordance with the movement of the sleeve 111*a*.

In the fore portion A, the carrier grains c rise in the form of brush chains with the result that the toner grains T confined in the mass of the carrier grains c are released due to oscillation and gaps generated and become free toner grains T. Further, the toner grains T deposited on the carrier grains c are subjected to an intense centrifugal force and released from the carrier grains c thereby, also constituting free toner grains T.

We observed the above behavior of the carrier grains c and toner grains T in the fore portion A, as well as in the successive portions B and C, with a stereoscopic microscope SZH10 (trade name) available from OLYMPUS OPTICAL CO., LTD. and a high-speed camera FASTCAM-ultima-I2 (trade name) available from PHOTRON LTD. The behavior was picked up at a speed of 500 frames for a second.

The free toner grains T can be easily moved by, e.g., an electric field for development, i.e., can contribute to development even if the electric field is weak because they are free from electrostatic and physical adhesion. Therefore, how many of such free toner grains T are used for development has critical influence on improvement in image quality. It has been customary to attain, without paying attention to the free toner grains T, development via a magnet brush and the use of toner grains present on part of a sleeve where the magnet brush is formed, resulting in unsatisfactory image density.

While the major object of the illustrative embodiment is to efficiently use the free toner grains T, the free toner grains T cannot be sufficiently produced or, if sufficiently produced, cannot be used in a high ratio, depending on the distance between the drum 1 and the sleeve 111*a* by way of example. The illustrative embodiment therefore determines specific conditions that produce sufficient free toner grains T and realize the sufficient use of such toner grains T. A specific method for optimization will be described hereinafter.

Figure 3:
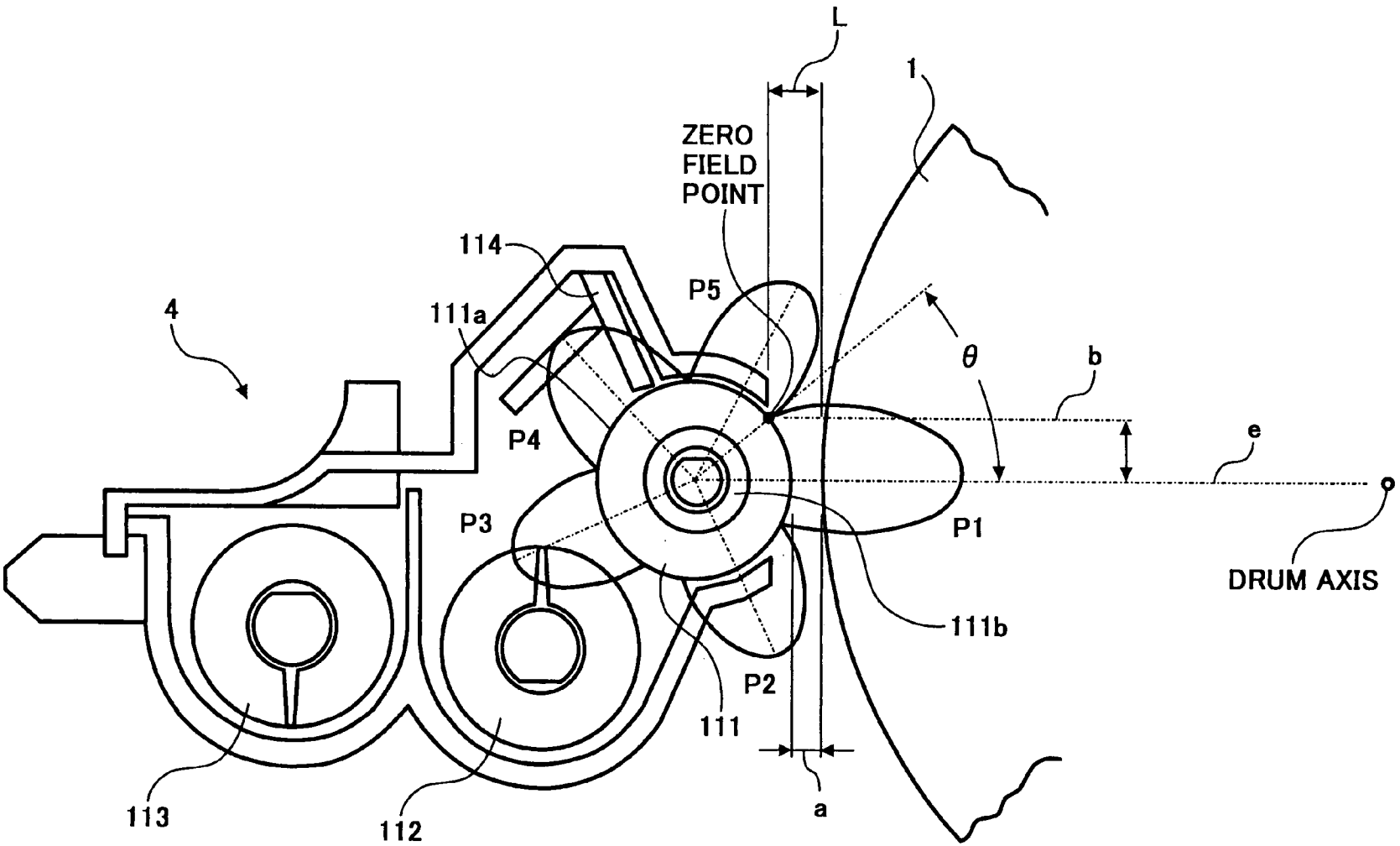
FIG. 3 is a front view showing a positional relation between an image carrier and a developer carrier included in a first embodiment of the present invention.

As shown in FIG. 3, assume that the magnet brush formed on the sleeve 111*a* has a height hat a point where the magnetic force of the main pole P1 is zero (zero field point hereinafter), and that the distance between the sleeve 111*a* and the drum 1, i.e., a development gap at a position where they are closest to each other is a. Then, a and h are set to be equal to each other. Also, assume that the angle from the gap for development to the zero field point is θ. Image quality is estimated by varying the combination of the angle θ and the outside diameters of the drum 1 and sleeve 111*a* as well as the height h. The illustrative embodiment sets various conditions by selecting a desirable or an optimum value or range out of the results of image quality estimation. It is to be noted that the height h is dependent on a doctor gap DG between the doctor blade 114 and the sleeve 111*a*.

More specifically, the angle e extends from a virtual line e connecting the axis of the sleeve 111*a* and the center of the main pole P1 to the zero field point. In the illustrative embodiment, the virtual line e extends through the axis of the drum 1 while it sometimes does not pass therethrough.

FIG. 4 lists the results of estimation of image quality, i.e., image density and granularity effected by varying the angle θ to 15°, 30° and 45°, varying the outside diameter of the sleeve 111*a* (Φdev) to 18 mm and 30 mm, varying the outside diameter of the drum 1 (Φpc) to 30 mm and 90 mm and belt, and varying the height h to 0.3 mm, 0.6 mm and 0.9 mm. In FIG. 4, the development gap is labeled GP. Circles are representative of high image quality while crosses are representative of low image density or conspicuous granularity. As FIG. 4 indicates, when the height h is 0.3 mm and the angle θ is 15°, high image quality is not achievable without regard to the diameter of the drum 1 if the diameter of the sleeve 111*a* is small, i.e., 18 mm.

Referring again to FIG. 3, assume a virtual line b parallel to the previously mentioned line e and passing through the zero field point, and assume that the distance between the zero field point and the drum 1 on the above line b is L. FIG. 5 shows distances L actually measured (including the results of computer simulations) while relating them to the results of image quality estimation shown in FIG. 4. In FIG. 5, shaded portions correspond to the cross (no good) portions of FIG. 4. As FIG. 5 indicates, if the distance L is 4 mm or above, then image density and therefore image quality is lowered. This is presumably because an excessive distance L makes the electric field too weak to convey the free toner grains T to the drum 1. Stated another way, assuming that the effective bias in the development nip is 400 V, then the free toner grains T are presumably not conveyed to the drum 1 if the electric field is less than 100 V/mm.

Further, when the outside diameter of the sleeve 111*a* is 30 mm and the angle θ is 45°, the free toner grains T are not conveyed without regard to the development gap, but scattered around out of the nip.

Considering the data shown in FIG. 5, the illustrative embodiment selects a distance L of 4 mm or below, preferably 3 mm.

Figure 6:
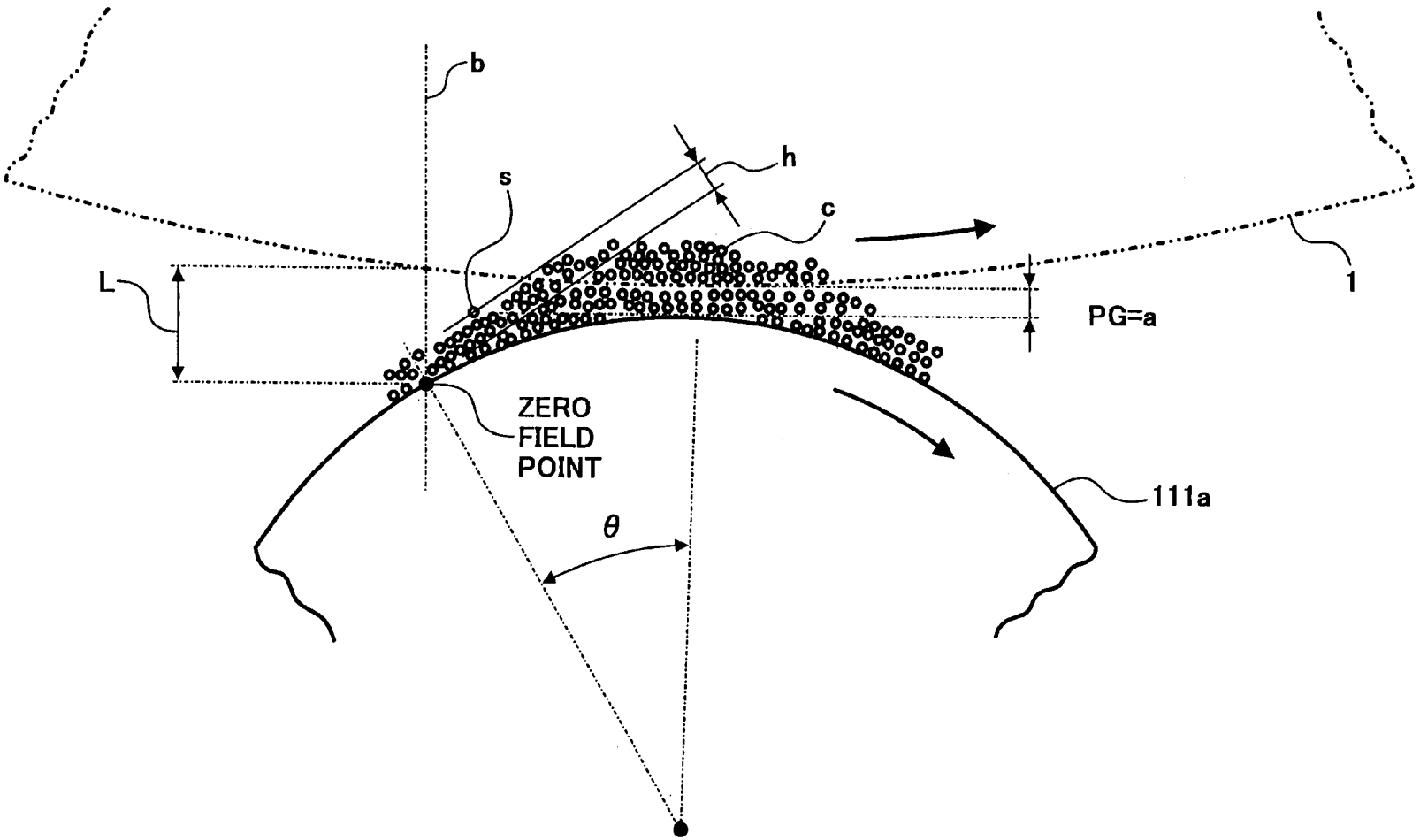
FIG. 6 is a sketch showing how brush chains formed by magnetic carrier grains start rising.

FIG. 6 is a sketch showing the result of an observation test. As shown, the developer layer started splitting and rising in the form of brush chains at a position s slightly past of the zero field point. It may therefore be considered that the free toner grains start appearing at the zero field point. This is why the illustrative embodiment uses the concept of the distance L for optimization. In FIG. 6, part of the magnet brush illustrated as if it were present inside of the drum 1 is representative of an apparent amount of bite.

FIG. 7 shows ratios L/h while relating them to the results of image quality estimation of FIG. 4. In FIG. 7, shaded portions correspond to the crossed (no good) portions of FIG. 4. As FIG. 7 indicates, granularity is conspicuous when the ratio L/h is less than 1.5, degrading image quality. This means that when the brush chains contact the drum 1 before sufficiently rising, free toner grains are not sufficiently produced or used. More specifically, although free toner grains are produced when the brush chains are rising, they are not fully available for development when obstructed in the early stage. In addition, when the brush chains contact the drum 1 in the early stage, the free toner grains are prevented from moving toward the drum 1. FIG. 7 further indicates that when the ratio L/h is less than 1.5, the brush chains hit against the toner image carried on the drum 1 and disturb it.

Considering the data shown in FIG. 7, the illustrative embodiment selects a ratio L/h of 1.5 or above, preferably 2 or above.

In the illustrative embodiment, the magnet constituting the main pole P1 is provided with a small cross-sectional area and may be implemented by a samarium alloy, particularly samarium-cobalt alloy. A magnet formed of ion-neodymium-boron alloy, which is a typical rare earth metal alloy, has the maximum energy product of 358 kJ/m$^3$ while a magnet formed of iron-neodymium-boron alloy bond has the maximum energy product of 80 kJ/m$^3$. Such a magnet can provide the surface of the sleeve 111*a* with a required magnetic force even if its size is noticeably reduced, compared to conventional magnets.

The maximum energy product available with the conventional ferrite magnet or the ferrite bond magnet is 30 kJ/m$^3$ or 20 kJ/m$^3$, respectively. If it is allowable to increase the diameter of the sleeve 111*a*, then a ferrite magnet or a ferrite bond magnet with a larger size may be used or the end of the magnet facing the sleeve 111*a* may be reduced in size for there by reducing the half-value center angle.

The magnetic carrier grains may be formed of iron, nickel, cobalt or similar metal or an alloy thereof, magnetite, γ-hematite, chromium dioxide, copper-zinc ferrite, manganese-zinc ferrite or similar oxide or manganese-copper-aluminum or similar whistler alloy or similar ferromagnetic substance. The grains of ferromagnetic substance may be coated with styrene-acryl, silicone, fluorine or similar resin, if desired. Any one of such substances may be suitably selected in consideration of the chargeability of the toner grains T.

A charge control agent, a conduction substance or the like may be mixed with the above-mentioned resin that may coat the magnetic grains. Further, the magnetic grains may be dispersed in styrene-acrylic, polyester or similar resin. The saturation magnetization of the ferromagnetic grains should preferably be between 45 emu/g and 85 emu/g. Saturation magnetization less than 45 emug/ is too low to implement expected conveyance, aggravating the deposition of the carrier grains on the drum 1. On the other hand, saturation magnetization above 85 emu/g is excessively high and intensifies the magnet brush and therefore the scavenging effect. Such a scavenging effect produces scavenging marks in a halftone portion, lowering image quality.

The toner grains T should contain at least thermoplastic resin and carbon black, copper phthalocyanine, quinaocrydone or bis-azo pigment. The thermoplastic resin should preferably be either one of styrene-acrylic resin and polyester resin. Further, the toner grains may contain polypropylene or similar wax and an alloy-containing dye as a fixation assisting agent and an electrification control agent, respectively. In addition, silica, alumina, titanium oxide or similar surface-treated oxide, a nitride or a carbonate may be coated on the toner grains T with or without fine grains of fatty acid or resin.

Figure 8:
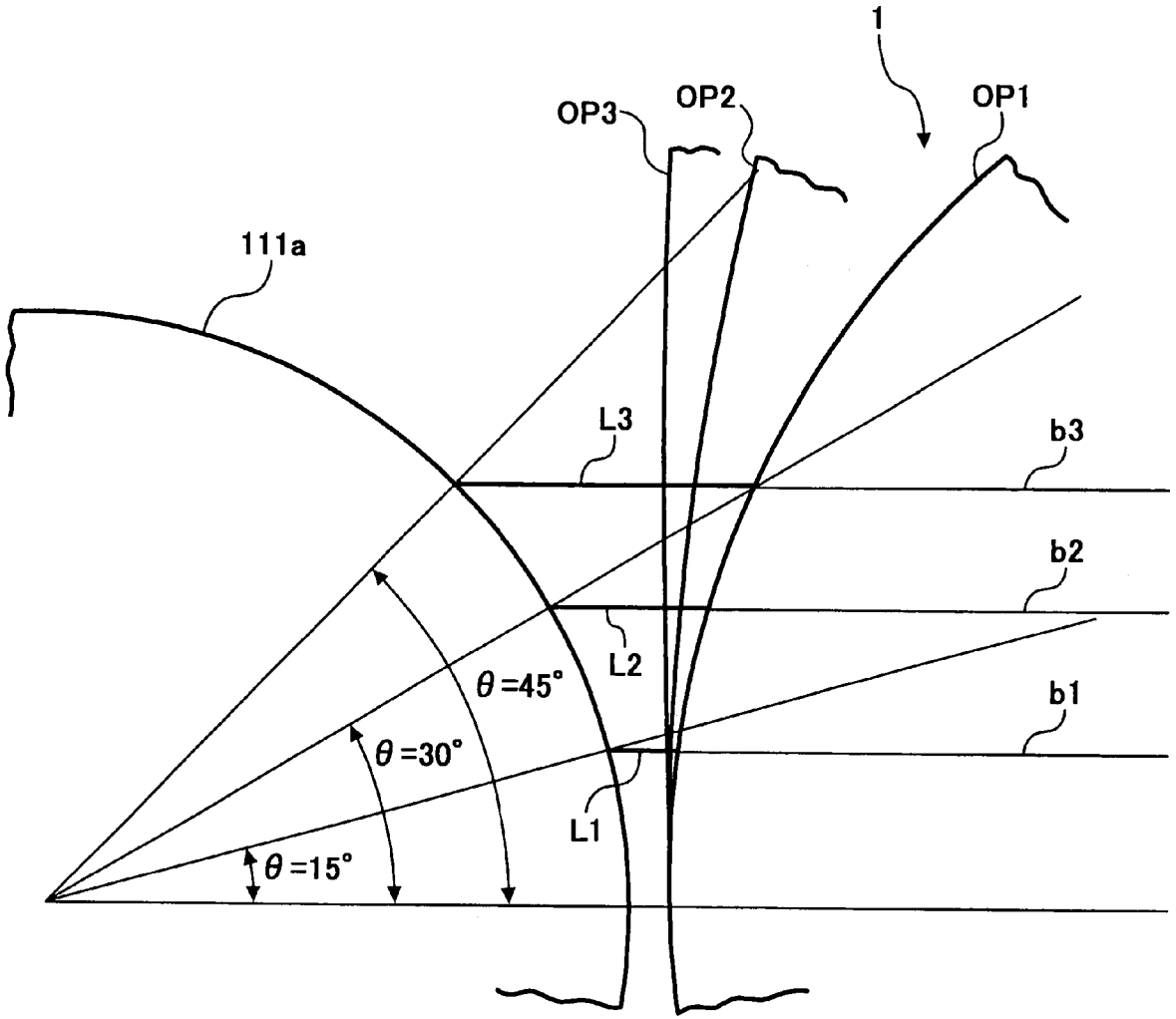
FIG. 8 shows a relation between the diameter of the image carrier and the distance between the zero field point and the image carrier.

FIG. 8 shows a relation between the diameter of the drum 1 and the distance L. In FIG. 8, OP1, OP2 and OP3 are respectively representative of a photoconductive drum with an outside diameter of 30 mm, a photoconductive drum with an outside diameter of 90 mm, and a photoconductive belt. As shown, when the angle θ is 15°, the distance from the zero field point is L1. Likewise, the distance is L2 when the angle θ is 300 or L3 when the angle is 45°. Optimization is also achievable with the photoconductive belt by using the same scheme.

While optimization unique to the illustrative embodiment has concentrated on the process cartridge, it is similarly applicable to the developing device or even to an image forming apparatus of the type having a fixed photoconductive drum.

Figure 9:
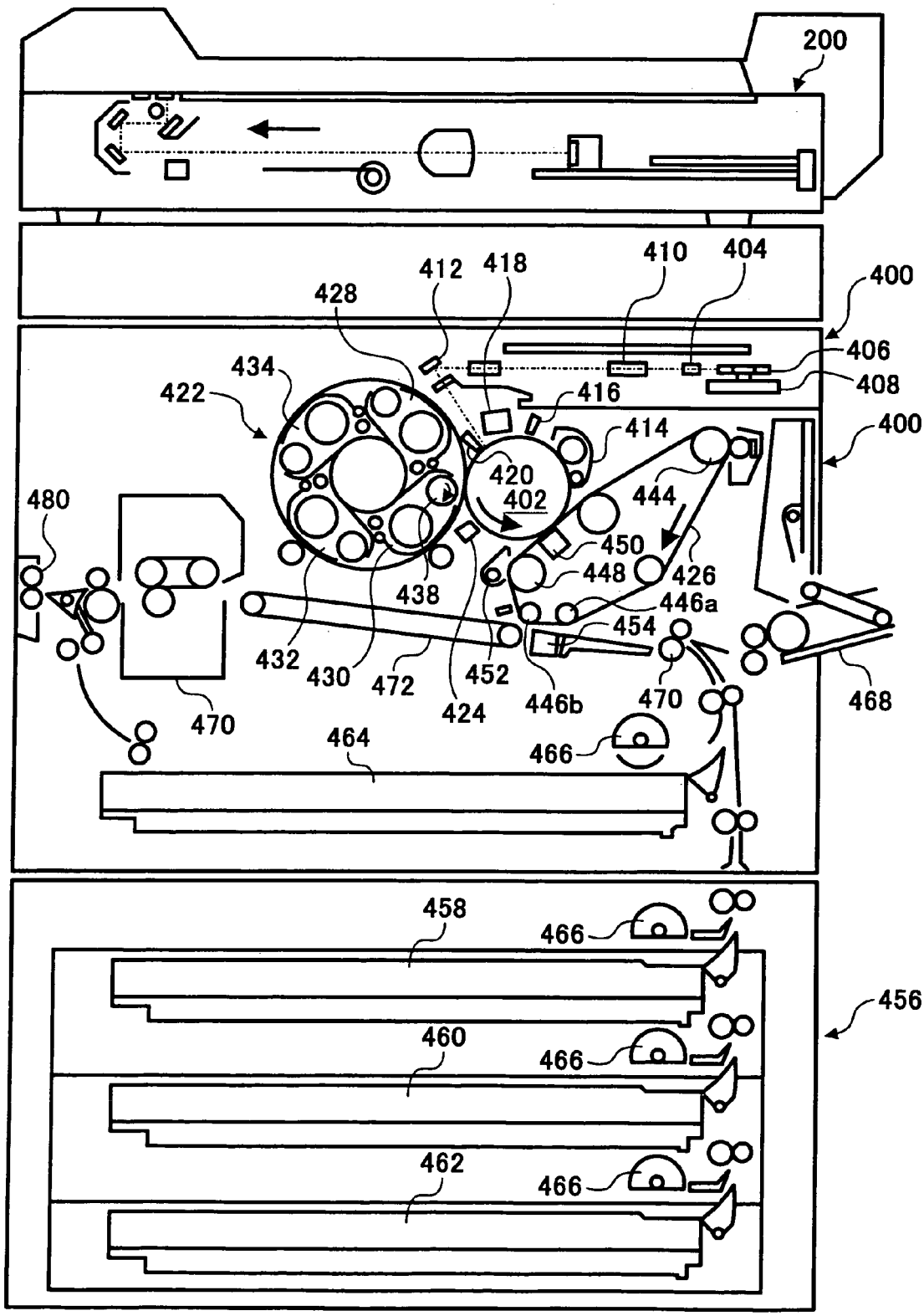
FIG. 9 shows a color copier to which preferred embodiments of the present invention are applicable.

Reference will be made to FIG. 9 for describing a color copier to which the optimization scheme of the illustrative embodiment is applicable. As shown, the color copier includes an optical writing unit or exposing means 400 configured to transform color image data received from a color scanner 200 to an optical signal and scan a drum or image carrier in accordance with the optical signal, thereby forming a latent image. The optical writing unit 400 includes a laser diode 404, a polygonal mirror 406, a mirror motor 408 assigned to the polygonal mirror 406, an f/θ lens 410, and a mirror 412. The drum 402 is rotatable counterclockwise, as indicated by an arrow in FIG. 9. Arranged around the drum 402 are a drum cleaner 414, a quenching lamp 416, a potential sensor 420, one of four developing sections included in a revolver type developing device 422, a density pattern sensor 424, and an intermediate image transfer belt 426. In FIG. 9, a developing section 438 included in the developing device (revolver hereinafter) 422 is shown as being located at a developing device adjoining the drum 402.

More specifically, the revolver 422 includes four developing sections 428, 430, 432 and 434 assigned to black, cyan, magenta and yellow, respectively, and a drive mechanism for causing the developing sections 428 through 434 to revolve. The developing sections 428 through 434 are identical in configuration except for the color of toner stored therein. In the stand-by state of the copier, the black developing section 428 is located at the developing position. On the start of a copying operation, the color scanner 200 starts reading black image data at a preselected timing. A latent image starts being formed on the drum 402 by a laser beam in accordance with the black image data. Let this latent image be referred to as a black latent image.

To develop the leading edge to the trailing edge of the black latent image, the sleeve of the black developing section 428 starts being rotated before the leading edge of the latent image arrives at the developing position, thereby developing the latent image with black toner. As soon as the trailing edge of the black latent image moves away from the developing position, the revolver 422 is rotated to bring the next developing section to the developing position. This rotation is completed at least before the leading edge of a latent image of the next color arrives at the developing position.

At the beginning of the image forming cycle, the drum 402 and intermediate image transfer belt (simply belt hereinafter) 426 are rotated counterclockwise and clockwise, respectively, by respective drive motors. A black (B) toner image, a cyan (C) toner image, a magenta (M) toner image and a yellow (Y) toner image are sequentially formed on the drum 402 while being sequentially transferred to the belt 426 one above the other in accurate register, completing a full-color image.

The belt 426 is passed over a drive roller 444, rollers 446*a* and 446*b* assigned to image transfer, a roller 448 assigned to belt cleaning and a plurality of driven rollers and driven by the motor. A corona discharger 454 transfers the full-color image from the belt 426 to a sheet.

A sheet bank 456 accommodates sheet cassettes 458, 460 and 462 each being loaded with a stack of sheets different in size from sheets stacked on a sheet cassette 464, which is accommodated in the copier body. A pickup roller 466 associated with designated one of the sheet cassettes 458 through 462 pays out a sheet toward a registration roller 470. A manual feed tray 468 is also mounted on the copier body for allowing the operator of the copier to feed OHP (Over-Head Projector) films, relatively thick sheets or similar special sheets by hand.

At the time when an image begins to be formed on the drum 402, one sheet is fed from any one of the sheet cassettes 458 through 464 or the manual feed tray 468 and stopped by the nip of the registration roller pair 470. The registration roller pair 470 starts being driven to convey the sheet at such a timing that the leading edge of the sheet meets the leading edge of the full-color image conveyed to the corona discharger 454 by the belt 426. The sheet is therefore conveyed by the belt 426 above the corona discharger 454 while being over laid on the full-color image. At this instant, the corona discharger 454 charges the sheet to positive polarity by corona discharge for thereby transferring the full-color image from the belt 426 to the sheet. Subsequently, a discharge brush, not shown, located at the left-hand side of the corona discharger 454, as viewed in FIG. 9, discharges the sheet, so that the sheet is separated from the belt 426 and transferred to a belt conveyor 472.

The belt conveyor 472 conveys the sheet carrying the full-color image thereon to a fixing device 470 of the type using a belt. The fixing device 470 fixes the full-color image on the sheet with heat and pressure. The sheet coming out of the fixing device 470 is driven out of the copier body to a tray, not shown, by an outlet roller pair 480 as a full-color copy.

In the color copier, the drum 402 and each of the developing sections 428 through 434 are also held in the optimum positional relation by the previously stated scheme.

As stated above, the illustrative embodiment sets various conditions on the basis of the results of image quality estimation for thereby selecting an optimum distance between the image carrier and the developer carrier. The optimum distance allows a sufficient amount of free toner grains to appear at a position where brush chains start rising and sufficiently contribute to development. It follows that a high-quality image with a dense, smooth solid portion is achievable without regard to the diameter of the image carrier.

Second Embodiment

A second embodiment of the present invention is directed toward the second object stated earlier. Essential part of the illustrative embodiment is substantially identical with the part of the previous embodiment shown in FIG. 1, and a detailed description thereof will not be made in order to avoid redundancy.

[1] Developing Device

Figure 10:
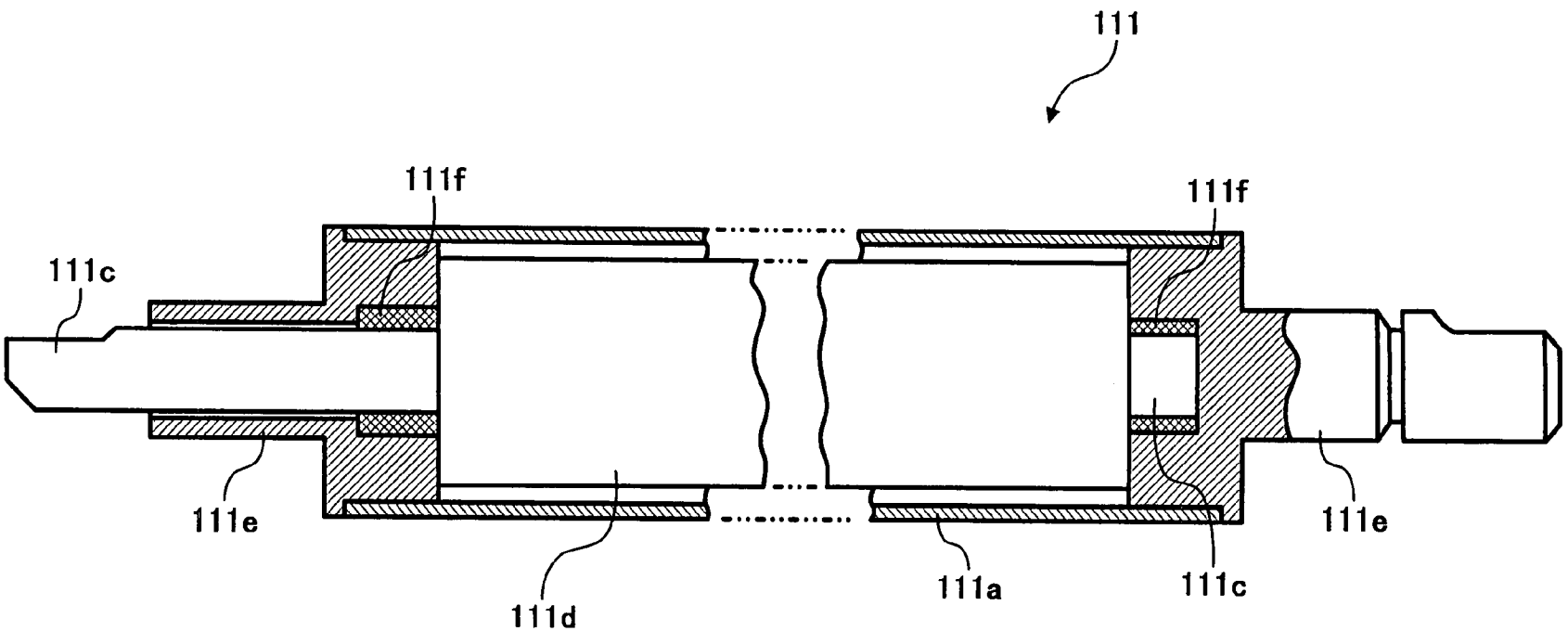
FIG. 10 is a section of a developing roller playing the role of the developer carrier.

As shown in FIG. 10, in the developing device 4 of the illustrative embodiment, the developing roller 111 is made up of a stationary shaft 111*c* affixed to the lower casing or stationary member 115*a*, a cylindrical magnet support 111*d* formed integrally with the shaft 111*c*, the sleeve 111*a* surrounding, but spaced from, the magnet support 111*d*, and a rotatable member 111*e* formed integrally with the sleeve 111*a*. The member 111*e* is freely rotatable relative to the shaft 111*c* via bearings 111*f*. Drive transmitting means, not shown, is drivably connected to the member 111*e*.

Figure 11:
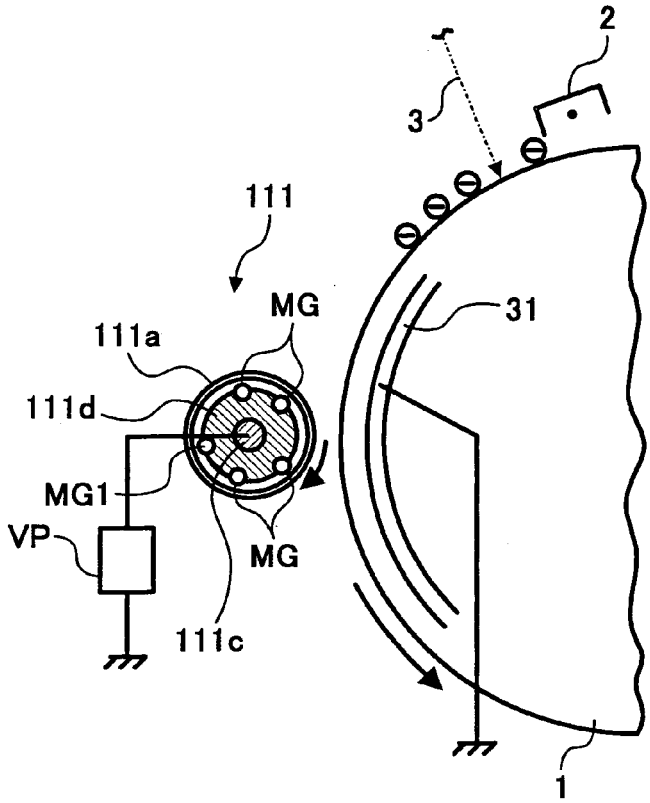
FIG. 11 shows bias applying means included in the developing device.

As shown in FIG. 11, a plurality of magnets MG are mounted on the stationary magnet support 111*d* at spaced locations along the circumference of the magnet support 111*d*. The sleeve 111*a* is rotatable around the magnets MG. The sleeve 111*a* is formed of aluminum, brass, stainless steel, conductive resin or similar nonmagnetic material as in the previous embodiment.

The magnets MG on the magnet support 111*d* form an electric field that causes the developer to rise on the sleeve 111*a* in the form of a magnet brush. More specifically, the carrier grains of the developer form brush chains along the magnetic lines of force issuing from the magnets MG in the normal direction. The charged toner grains of the developer deposit on the carrier grains, constituting a magnet brush.

The developing zone stated earlier is formed between the sleeve 111*a* and the drum 1 adjoining each other. Because the drum 1 and sleeve 111*a* both are cylindrical, the developing zone sequentially broadens from the point where the drum 1 and sleeve 111*a* are closest to each other toward opposite sides. The sleeve 111*a* in rotation conveys the magnet brush through such a developing zone.

The magnetic lines of force or magnetic force distributions P1 through P5, FIG. 1, each are constituted by particular one of the magnets MG. The magnets MG each are directed in the radial direction of the sleeve 111*a*. Among, them, the magnet MG with the magnetic force distribution P1 that forms the main pole is formed of the same material and provided with the same configuration as described in relation to the previous embodiment.

As for the material of the carrier grains, which form part of the developer, the illustrative embodiment is identical with the previous embodiment.

As shown in FIG. 11, a power supply VP is connected to the stationary shaft 111*c* while being connected to ground. A voltage or bias applied from the power supply VP to the shaft 111*c* is applied to the sleeve 111*a* via the conductive rotary member 111*c*. On the other hand, a conductive base 31, which forms the lowermost layer of the drum 1, is connected to ground.

With the above arrangement, the illustrative embodiment forms in the developing zone and an electric field that causes the toner grains to move toward the drum.

[2] Developing Method

With the developing device described in [1] above, the illustrative embodiment is capable of executing developing methods to be described hereinafter. It is to be noted that the developing device described in [1] is not essential in executing developing methods to be described, but may be replaced with any other developing device so long as various conditions to be described hereinafter are satisfied. Again, the fore portion A, middle portion B and hind portion C, FIG. 2, constituting the developing zone will be used for the description of developing methods.

[2-1] Method Using Free Toner Based on Carrier Displacement

Briefly, this developing method is such that when the carrier grains with the toner grains deposited thereon start ring along the magnetic lines of force of the magnet in the form of brush chains, the toner grains are released from the carrier grains due to the relative displacement of the carrier grains and develop a latent image. This method is practicable with the behavior of the developer occurring in the fore portion A of the developing zone.

More specifically, in the fore portion A, the toner grains T are released from the brush chains constituted by the carrier grains c and develop a latent image. Although the toner grains and free toner grains are identical with each other, the free toner grains will be labeled T' hereinafter for distinction.

Again, the developing zone refers to a zone where toner grains T, forming part of the developer, move toward the drum 1 for development without regard to whether magnetic carrier grains c, forming the other part of the developer, gather to form a magnet brush or whether the thin developer layer is formed on the sleeve 111*a*. While the fore portion A may be simply defined as a range upstream of the middle portion B, it may alternatively be defined as a range where a plurality of carrier grains c with the toner grains T deposited thereon and approached the main magnetic force distribution P1 gather to form brush chains and start rising along the magnetic lines of force.

Figure 15:
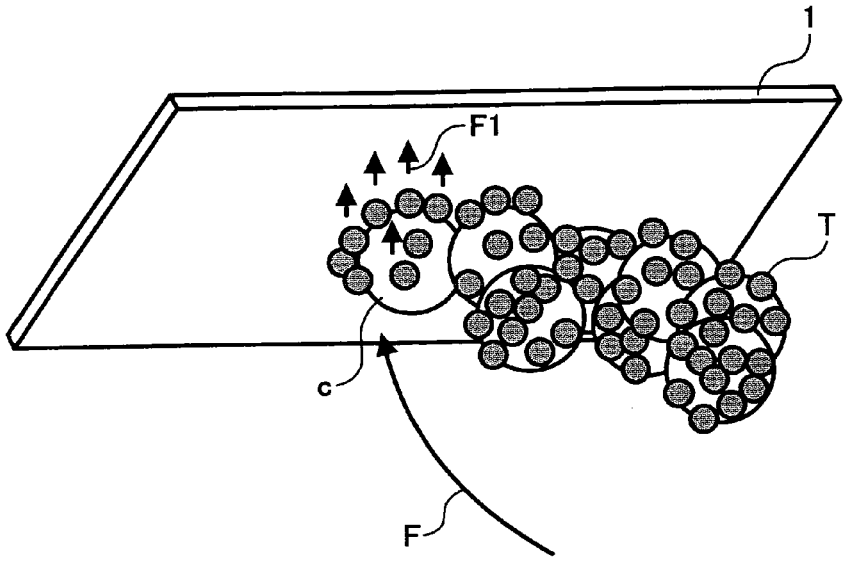
FIG. 15 is a sketch showing how the brush chains of carrier grains strongly contact the image carrier in a middle portion also including in the developing zone.

The magnets positioned inside the sleeve 111*a*, as shown in FIG. 11, form the main magnetic force distribution P1 and other magnetic force distributions P3, P4, P5 and P2, as stated previously. In FIGS. 1, 11 and 15, the developer forms a magnet brush without regard to the polarity of a magnet in accordance with the magnetic force distribution particular to the magnet, while forming a thin layer between nearby magnetic force distributions.

The developing method [2-1] will be described with reference to FIG. 12. At a position between near by magnetic field force distributions, e.g., P5 and P1 shown in FIG. 1, while a magnetic line of force in the direction normal to the sleeve 111*a* is small, a magnetic line of force in the circumferential direction of the sleeve 111*a* is great because nearby magnets are opposite in polarity to each other. In this condition, the carrier grains care confined in a relatively thin developer layer, compared to the carrier grains c on the magnetic field distributions.

Figure 12:
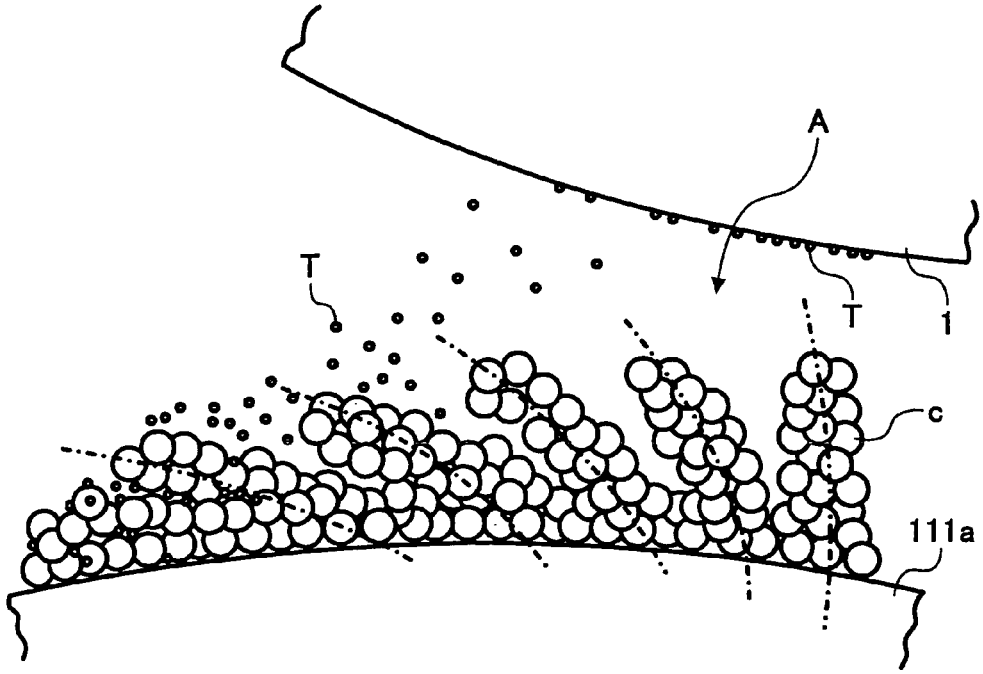
FIG. 12 is a sketch showing the behavior of the developer in a fore portion included in a developing zone.

As shown in FIG. 12, when the developer layer approaches the main magnet P1 in accordance with the rotation of the sleeve 111*a*, some carrier grains c gather to form a brush chain and start rising on the sleeve 111*a*. Generally, the number of carrier grains c forming the brush chain is determined by the amount of developer to move past the doctor blade 114. Other factors that determine the number of carrier grains c include the size and slope of magnetic line of force dependent on the magnetic property of the carrier grains c, the magnetic force of the main magnetic force distribution P1, and the shape and position of the magnet MG forming the distribution P1.

Further, although the magnet MG forming the main magnetic force distribution P1 is affixed to the magnet support 111*d*, the angle and size of the magnetic line of force at the position where the carrier grains c start rising vary because the sleeve 111*a* is in rotation. At this instant, the carrier grains c do not immediately form a brush chain along the magnetic line of force due to delay in magnetic response. Moreover, although the brush chain rises by being freed from the restraint of the mass, repulsion acts between the carrier grains because all the carrier grains c are oriented in the same direction as to polarity due to the intense magnetic field of the main magnetic field distribution P1.

For the reasons described above, the layer of the carrier grains c abruptly splits with the result that the carrier grains c rise in the form of a brush chain and are spatially freed. Further, the toner grains T deposited on the carrier grains c are released from the carrier grains c due to the intense centrifugal force acting thereon and become free toner grains T flying in the developing space. In the illustrative embodiment, such a process in which the free toner grains T appear is translated as the release of the toner grains T from the carrier grains c that occurs due to the relative displacement of the carrier grains c when the carrier grains c rise along the magnetic line of force.

The free toner grains T released form the carrier grains c can be easily moved by, e.g., the magnetic field for development because the toner grains T are free from electrostatic and physical attraction between them and the carrier grains c.

Figure 13:
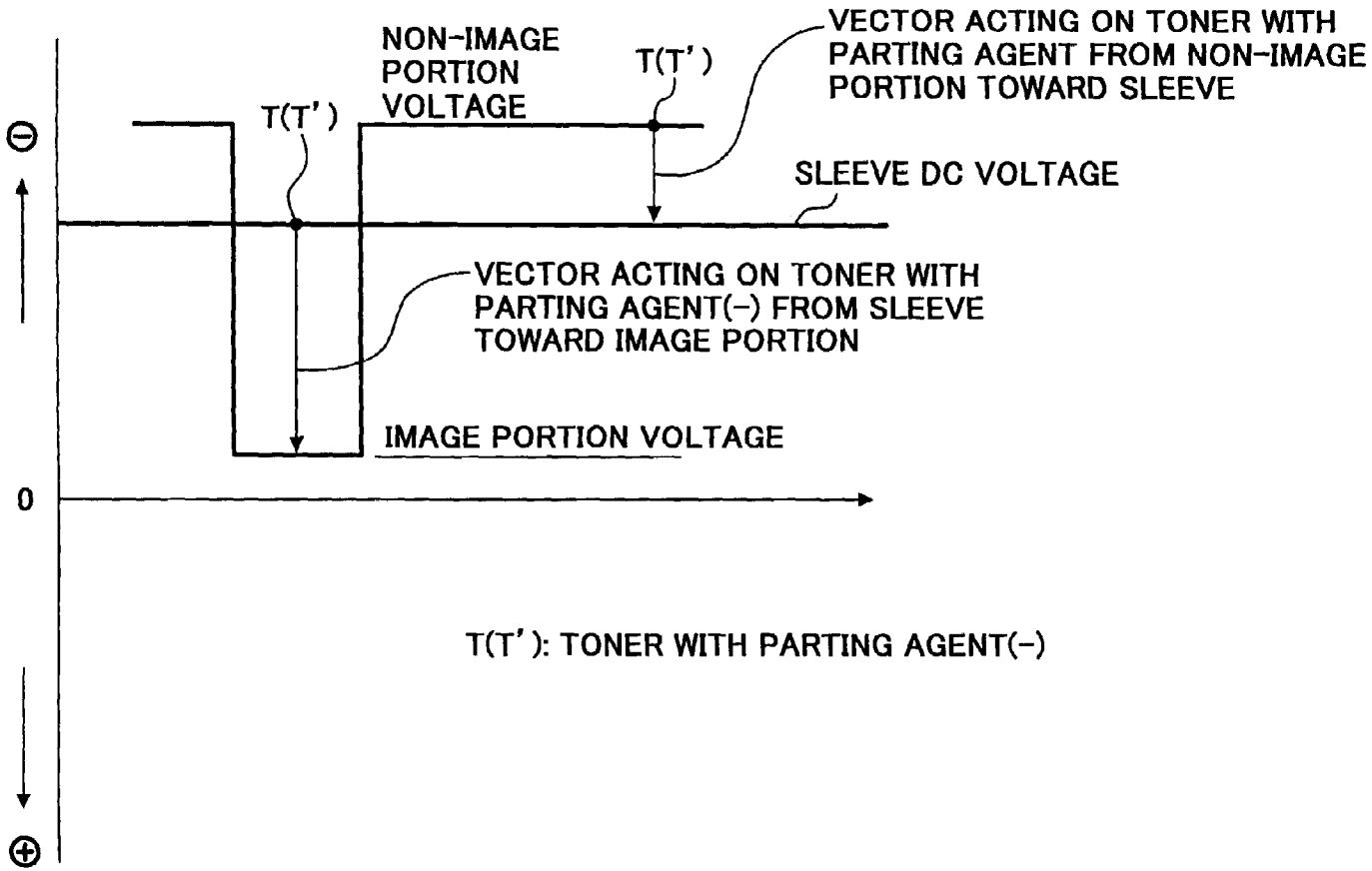
FIGS. 13 and 14 each show a particular electrostatic force acting on toner on the image carrier.

FIG. 13 demonstrates a specific case wherein the power supply VP, FIG. 11, is implemented as a DC power supply, a DC electric field is applied for reversal development. It is a common practice with the drum 1 using an organic pigment as a carrier generating material to deposit negative charge and develop a latent image with negatively charged toner. This is also true with the illustrative embodiment. Of course, the polarity of charge to deposit on the drum 1 is not an issue in the development system.

When the laser beam 3 is used to write an image on the drum 1, a character portion is exposed in order to reduce the amount of exposure. Therefore, holes produced from the carrier generating material neutralize the charge of the character portion. As a result, as shown in FIG. 13, the potential of an image portion representative of a character portion is lowered. The power supply VP, FIG. 11, connected to the sleeve 111*a* applies a DC voltage biased to the negative side to such an image portion. Consequently, a vector extending from the sleeve 111*a* toward the image portion acts on the negatively charged, free toner grains T and causes them to effect development.

In FIG. 13, the toner grains T, in practice, do not exist in the non-image portion of the drum 1. Even if the toner grains T exist in the non-image portion, they are surely removed from the non-image portion by a vector extending from the non-image portion toward the sleeve 111*a*. This surely protects the background of the image 1 from contamination.

This developing method can produce the free toner grains T by control ling the force to act on the toner grains T, which are deposited on the carrier grains c, on the basis of the grain size and other properties of the carrier grains c, the magnetic characteristics of the carrier grains c including the intensity of saturation magnetization, and the intensity of saturation magnetization and other magnetic characteristics and width, shape and other configurations of the main magnetic force distribution. Further, by forming a magnet brush including the free toner grains T, it is possible to increase the amount of toner grains T to deposit on the latent image L for thereby enhancing the developing ability.

Figure 14:
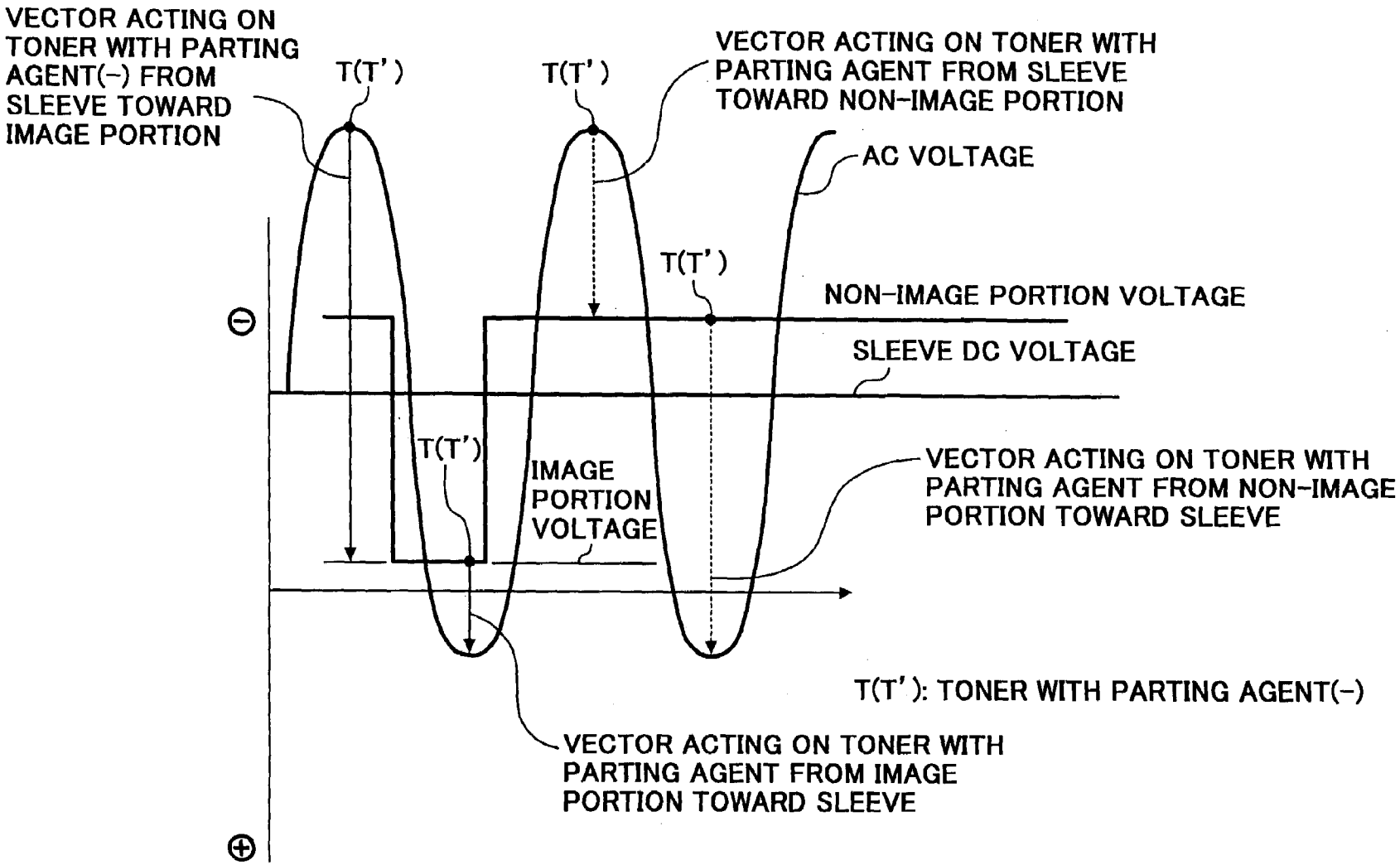

FIG. 14 shows another specific case wherein the power supply VP, FIG. 11, is implemented as an AC-biased DC power supply, and an alternating electric field is formed for reversal development. The alternating electric field should preferably have a frequency of 2 kHz to 5 kHz. As shown, the toner grains T charged to, e.g., negative polarity deposit on the drum 1 due to the electric field formed between the sleeve 111*a* and the drum 1 as in the previous specific case.

More specifically, the alternating electric field biased to the negative side allows the free toner grains T to surely reach an image portion while being subjected to a vector extending toward the image portion. Again, even if the toner grains T exist in the non-image portion, they are surely removed from the non-image portion by a vector extending from the non-image portion toward the sleeve 111*a*. This surely protects the background of the image 1 from contamination.

As stated above, this developing method produces in the fore portion A the free toner grains T that can be moved even by a low electric field for development, thereby enhancing the developing ability even with the toner contained in the developer. In addition, the free toner grains produced in the fore portion A serve to promote development in the middle portion B and hind portion C following it.

We observed the above behavior of the carrier grains c and toner grains T in the fore portion A, as well as in the successive portions B and C, with a stereoscopic microscope SZH10 available from OLYMPUS OPTICAL CO., LTD. and a high-speed camera FASTCAM-ultima-I2 available from PHOTRON LTD. The behavior was picked up at a speed of 500 frames for a second. This is also true with the middle portion B and hind portion to be described hereinafter.

[2-2] Development with Brush Chain Contacting Drum

Briefly, this developing method is such that brush chains formed by the carrier grains c are caused to contact the drum 1 in the middle portion B of the developing zone while releasing the toner grains, and these toner grains or free toner grains T are scattered on the drum 1. The brush chains may contact the drum 1 in such a manner as to strongly contact or hit against the drum 1. Such development in the middle portion B follows the development effected in the fore portion A.

More specifically, as shown in FIG. 2, the toner grains T are scattered from the carrier grains c onto the drum 1 in the middle portion B. At this instant, the brush chains of the magnet brush strongly contact the drum 1 to thereby scatter the toner grains T. FIG. 15 shows this condition more specifically.

The size, particularly the height, of each brush chain formed by the carrier grains c in the middle portion B is determined by the characteristics of the carrier grains c and those of the main magnetic field distribution P1 stated previously. Therefore, in the middle portion B, the brush chain on the sleeve 111*a* moves at substantially the same speed as the sleeve 111*a* except when the former slips on the latter. Consequently, when the height of the brush chain is greater than the distance between the sleeve 111*a* and the drum 1, the brush chain strongly contacts the drum 1 in a direction F at both of the speed at which the brush chain rises along the main magnetic field distribution P and the peripheral speed of the sleeve 111*a*.

Even if the brush chain fully rises on the sleeve 111*a* before contacting the drum 1, it moves toward the position where the sleeve 111*a* and drum 1 are closest to each other. Therefore, when the height of the brush chain is greater than the smallest distance between the sleeve 111*a* and the drum 1, the brush chain strongly contacts the drum 1 at a speed produced by subtracting the peripheral speed of the drum 1 from that of the sleeve 111*a*.

In any case, the height of the brush chain naturally becomes greater than the distance between the sleeve 111*a* and the drum 1 because of the movement of the magnet brush occurring in the middle portion B in accordance with the rotation of the sleeve 111*a*.

On strongly contacting the drum 1, the carrier grains c cause the toner grains T to part due to the resulting impact. The toner grains T so parted from the carrier grains c move toward the drum 1 in a direction F1 due to inertia derived from the centrifugal force, an electric field formed by the latent image present on the drum 1, and the electric field formed between the sleeve 111*a* and the drum 1.

This development method may use either one of an AC voltage and an AC-biased DC voltage for development and is executed in the same manner as described with reference to FIGS. 13 and 14.

As stated above, the free toner grains T separated from the carrier grains c by a bias or similar external force other than an electrostatic force can desirably develop the latent image present on the drum 1.

In the middle portion B, the following development additionally occurs in conjunction with the development in the fore zone A. The free toner grains T produced in the fore portion A are directly migrated toward the drum 1 by the electric field. In the middle portion B following the fore portion A, not only further toner grains T are scattered from the carrier grains c onto the drum 1, but the carrier grains c collect the toner grains T present on the drum 1. More specifically, the toner grains T deposited on the non-image portion or the low-potential image portion of the drum 1 in the fore portion A and middle portion B are returned to the sleeve 111*a*, so that the resulting image is free from background contamination.

Because the carrier grains c on the sleeve 111*a* are dielectric, a further enhanced electric field is formed on the drum 1 and brush chain, which is a mass of carrier grains c, causing the toner grains T to part from the carrier grains c and deposit on the drum 1. Further, the alternating electric field causes the toner grains T on the drum 1 to move in such a manner as to oscillate, so that the toner grains T are arranged faithfully to the latent image for thereby implementing high image quality. At this instant, too, when the brush chain adjoins the drum 1, an electric field further enhanced by the carrier grains c is formed and causes the toner grains T to move more actively, thereby further enhancing image quality.

[2-3] Development with Tip of Brush Chain Contacting Drum

This method causes the tip of the brush chain risen on the sleeve 111*a* along the magnetic line of force to move in contact with the drum 1. An image portion is developed by the electric field formed between the drum 1 and the sleeve 111*a* and the electric field formed between the drum 1 and the carrier grains c. At the same time, as for a non-image portion, the toner grains present on the drum 1 are returned toward the carrier grains c.

Figure 16:
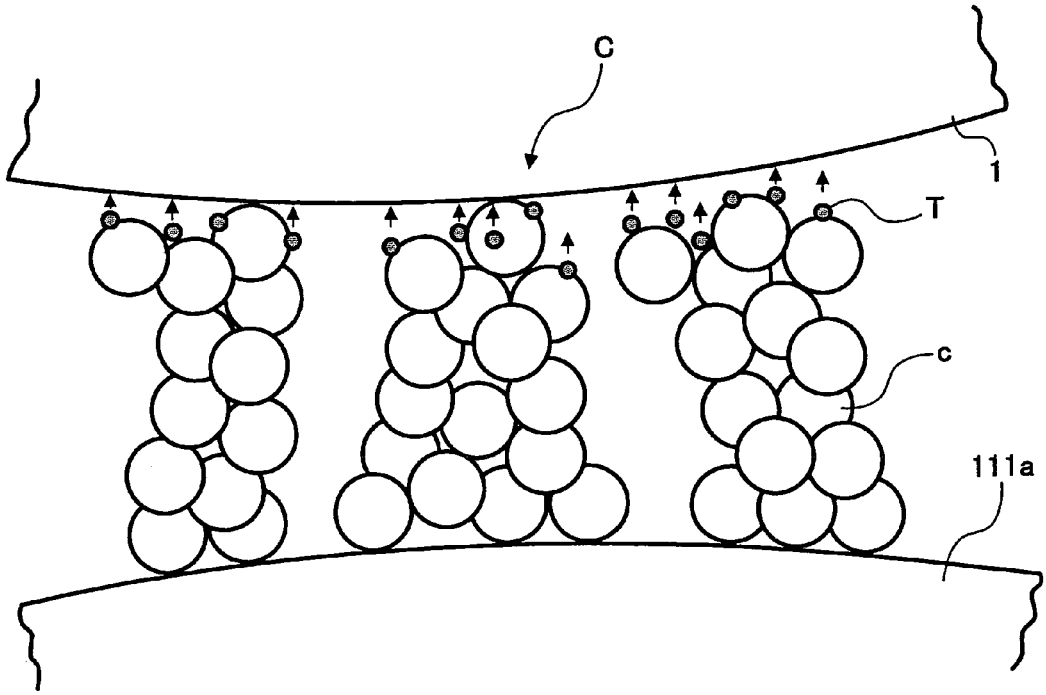
FIG. 16 is a sketch showing how the brush chains behave in a hind zone also included in the developing zone.

This method is executed mainly in the hind portion C of the developing zone. Therefore, an arrangement is made such that brush chains formed on the carrier grains c rub on the drum 1 while being conveyed on the sleeve 111*a*. FIG. 16 demonstrates the developing method. In FIG. 16, an electric field for development is usually formed between the sleeve 111*a* and the drum 1, see FIGS. 11, 13 and 14.

In the hind portion C, the number of toner grains T remaining on the carrier grains c is small because many toner grains T have been released from the toner grains c in the fore portion A and middle portion B. As shown in FIG. 16, in the hind zone C, the carrier gains c with excessive charge move while rubbing on the drum 1 and overtake and strongly contact the toner grains T deposited on the drum 1. The resulting impact and the electrostatic Coulomb's force derived from the opposite polarities of the carrier grains c and toner grains T cause the carrier grains c to collect the toner grains T from the drum 1.

In this case, the charge deposited on the drum 1 by the charger 2 and therefore the electric field retaining the toner grains T on the drum 1 is small mainly in the non-image portion, so that the toner grains T are tend to part from the non-image portion. This reduces or obviates the contamination of the non-image portion for thereby insuring high image quality. In this manner, the developing method protects the background of an image from contamination not by positively depositing the toner grains T, but by collecting them from the non-image portion.

[2-4] Development in Consecutive Portions A through C

In the apparatus with the configuration shown in FIGS. 1, 10 and 11, this developing method executes the development in the consecutive zone A through C described in [2-1] through [2-3] above as a sequence of developing steps. This development method therefore insures high image density, renders a solid image portion smooth, faithfully reproduces dots, and obviates background contamination.

[2-4-1] Development with Peak of Magnetic Force Shifted

The magnetic force distribution P2 downstream of the main magnetic force distribution P1 helps the main magnetic force distribution P1 be formed. If the magnetic force distribution P2 is excessively small, then the carrier grains c deposit on the drum 1. The magnet brush is conveyed in accordance with the rotation of the sleeve 111*a* in the same direction as the sleeve 111*a*, i.e., clockwise.

Figure 17:
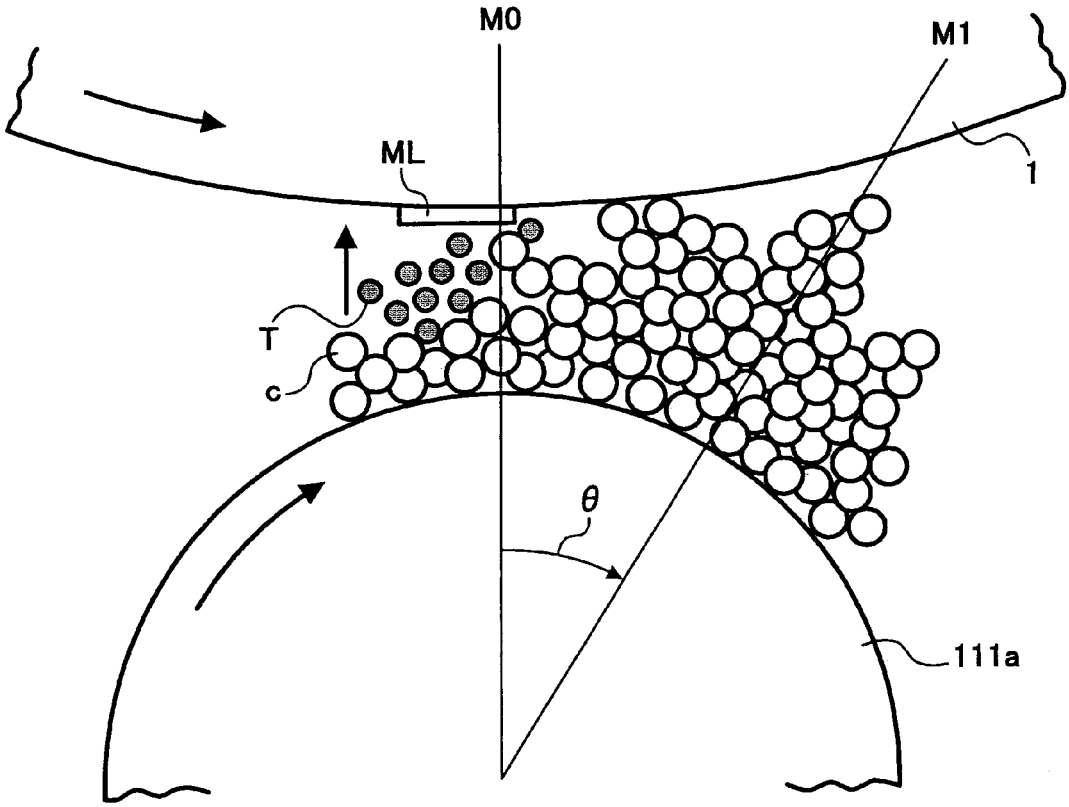
FIG. 17 demonstrates development to occur when the peak position of a magnetic force is shifted from the closest position.

As shown in FIG. 17, the magnets MG on the magnet support 111*d* are arranged such that the main magnetic field distribution P1 has a peak M1, as measured in the direction normal to the sleeve 111*a*, located downstream of a position M0 where the drum 1 and sleeve 111*a* are closest to each other in the direction of movement of the drum 1, i.e., counterclockwise. Stated anther way, the peak M1 of the magnetic force around the sleeve 111*a* is shifted from the position M0, which is represented by a virtual line connecting the axis of the drum 1 and that of the sleeve 111*a*, to the downstream side by an angle θ of 0° to 30°. In this condition, the portion where the free toner grains T appear in the initial stage of brush formation is shifted to the middle portion B of the developing zone inclusive of the position M0 where the free toner grains T easily move toward a latent image ML. More specifically, part of the fore portion A where the free toner grains T appear, as stated earlier, is located to face the position M0, thereby promoting the transfer of the free toner grains T to the drum 1.

The angle between the magnets MG forming the main magnetic force distribution P1 and magnetic force distribution P5, respectively, is 60°, so that the magnetic force is zero at an angle of 30° between the two magnets MG. Stated another way, the magnet brush rises at or around the position M0 or the skirt portion of the main magnetic field distribution P1 is located at or around the position M0.

[2-4-2] EXAMPLE 1

Development was effected with the image forming apparatus shown in FIG. 9 and the configurations described in [2-4] and [2-4-1] above and under the following conditions.

(i) Mechanical Conditions

An arrangement is made such that the toner grains T part from the carrier grains c when brush chains constituted by the carrier grains c rise in consideration of the powder and magnetic characteristics of the carrier grains c and the magnetic and configuration characteristics of the main magnet, which forms the main magnetic force distribution P1.

Also, the configuration and electric characteristics of the sleeve 111*a* and those of the drum 1 are so selected as to form an electric field that causes the toner grains T parted from the carrier grains c to move toward the drum 1. The free toner grains T should therefore deposit on the drum 1 as rapidly as possible. For this purpose, Example 1 formed an electric field with a rectangular wave as distinguished from the previously stated alternating electric field.

In Example 1, the drum 1 had a diameter of 90 mm and was moved at a linear velocity of 156 mm/sec while the sleeve 111*a* had a diameter of 18 mm and was moved at a linear velocity of 214 mm/sec. Experiments showed that even when the ratio of the linear velocity Vs of the sleeve 111*a* to the linear velocity Vp of the drum 1 (Vs/Vp) was as low as 0.9, necessary image density was attainable.

The gap between the drum 1 and the sleeve 111 was selected to be 0.6 mm. It has been customary to limit, assuming a carrier grain size of 50 μm, above gap to 0.65 or below, i.e., thirteen times or less as great as the carrier grain size. If the gap is excessively small, then the range over which the magnet brush contacts the drum 1 becomes wider and aggravates the direction-dependency of an image, e.g., thinning of horizontal lines and the omission of the trailing edge of an image. Conversely, if the gap is excessively large, then sufficient field strength is not achievable, resulting in image defects including irregularity in solitary dots and solid image portions. While a bias voltage may be raised to maintain required field strength, this kind of scheme is apt to bring about the local, spot-like omission of a solid image ascribable to discharge.

The doctor gap between the doctor blade 114 and the sleeve 111*a* was selected to be 0.65 mm. A doctor blade has customarily been implemented as a simple plate formed of a nonmagnetic material. In the illustrative embodiment, the doctor blade 114 is implemented as a plate formed of a magnetic material and adhered to the conventional nonmagnetic plate. The magnetic material promotes the formation of brush chains with uniform height, as will be described later more specifically.

A screw, not shown, is located at the opposite side to the drum 1 with respect to the sleeve 111*a* in order to scoop up the developer onto the sleeve 111*a* while agitating it. More specifically, the screw is driven at a speed of 152 rpm by drive mans, not shown, to thereby charge the toner grains T of the developer by friction by an amount (q/m) of −5 μC/g to −60 μC/g, preferably −10 μC/g to −30 μC/g.

(ii) Developer

Use was made of a two-ingredient type developer produced by the following specific procedure.

<Toner>

Binder Resin: 100 parts of polyester resin (polyester resin synthesized from terephthalic acid, fumaric acid, polyoxypropylene-(2,2)-2,2-bis(4-hydroxyphenyl) propane and trimellitic acid; Tg of 62° C.; softening point of 106° C.)

Colorants: 7.0 parts of pigment for yellow toner (disazo yellow pigment: C.I. Pigment Yellow 17), 7.0 parts of pigment for magenta toner (quinacridone-based magenta pigment: C.I. Pigment Red 122), 3.5 parts of pigment for cyan toner (copper phthalocyanine blue pigment: C.I. Pigment Blue 15:3), and 6.0 parts of pigment for black toner (carbon black: C.I. Pigment Black 7)

Charge Control Agent: 2.5 parts of zinc salt of salicylic acid derivative

Parting Agent: 5 parts of carnauba wax(melting point of 85° C.)

The above substances were mixed in a Henschel mixer and then melted and kneaded in a biaxial kneader at 110° C. The resulting mixture was water-cooled, coarsely crushed in a cutter mill, and then crushed in a fine crusher using a jet stream to obtain matrix grains by use of a pneumatic classifier.

Subsequently, 100 parts of matrix particles and additives, i.e., 0.8 parts of silica (surface treating agent of hexamethyldisilazane with a mean primary grain size of 0.01 μm) and 1.0 parts of titania (surface treating agent of isobutyl trimethoxysilane with a mean primary grain size of 0.015 μm) were mixed in the Henschel mixer, pneumatically sieved by a sieve with 100 μm aperture to obtain toner grains with a weight-mean diameter of 6.8 μm.

While various methods are available for measuring the grain size distribution of the toner, the specific procedure used a Calter multisizer model II e (trade name) available from Calter. An interface available from Nikkaki Co., Ltd. and a personal computer were connected to the multisizer for outputting a number distribution and a volume distribution. As for an electrolyte, a 1% electrolyte NaCl aqueous solution was prepared by using extra pure sodium chloride.

As for a measuring method, 0.1 ml to 5 ml of surfactant, preferably alkylbenzene sulfonate, was added to 100 ml to 150 ml of the above aqueous electrolyte as a dispersant. Further, 2 mg to 20 mg of the sample to be measured was added. The resulting mixture was dispersed by an ultrasonic dispersing unit for about 1 minute to 3 minutes. On the other hand, 100 ml to 200 ml of the aqueous electrolyte was introduced in another beaker. The sample dispersion liquid stated above was added to the aqueous electrolyte to a preselected concentration. Thereafter, the mean grain size of 50,000 grains was determined by use of the Calter multisizer model II e and 200 μm aperture.

<Carrier>

Core: 5,000 parts of Cu—Zn ferrite grains (weight-mean particle size of 45 μm )

Coating Material: 450 parts of toluene, 450 parts of silicone resin SR2400 (trade name) available from Toray-Dowcorning Silicone, Inc. and containing 50% of nonvolatile component, 10 parts of aminosilane SH6020 (tradename) available from Toray-Dowcorning Silicone, Inc. and 10 parts of carbon black.

The above coating material was dispersed by a stirrer for 10 minutes to prepare a coating liquid. The coating liquid and core were introduced in a coating device including a rotary bottom disk and stirring blades within a fluidizing bed to form a swirl stream for coating, so that the coating liquid coated the core. Further, the resulting carrier was baked in an electric furnace at 250° C. for 2 hours to thereby produce carrier grains with film thickness of 0.5 μm.

<Developer>

7 parts of the toner and 93 parts of the carrier produced by the above specific procedure were mixed by a turbuler mixer to thereby produce a two-ingredient type developer.

(iii) Mode of Development

Figure 18A:
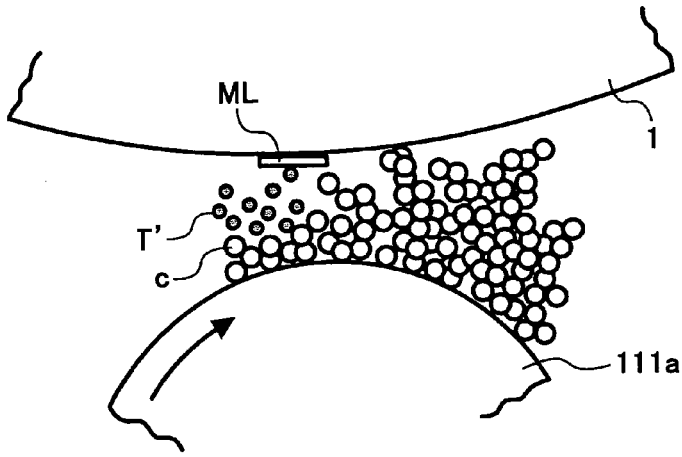
FIGS. 18A through 18C are sketches demonstrating consecutive developing stages in which the brush chains may contact the image carrier in the developing zone.
Figure 18B:
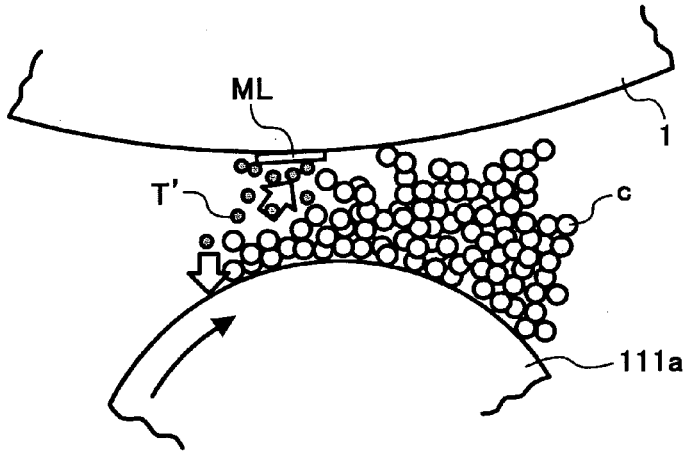
Figure 18C:
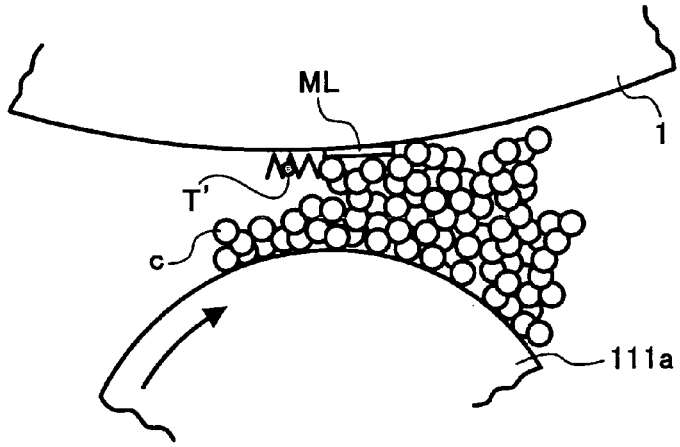

How development proceeds under the above specific conditions will be described with reference to FIGS. 18A through 18C, taking the case with the shifted peak position described in [2-4-1] as an example. The free toner grains T produced in the fore portion A in the form of cloud or smoke are mostly easily movable toward the drum 1 because of the electric field acting thereon. FIGS. 18A through 18C demonstrate development effected by the free toner grains T' stepwise.

As shown in FIG. 18A, in the fore portion A where the magnet brush having been pressed against the sleeve 111*a* starts rising, a space that allows the toner grains T to move around is formed in the magnet brush due to the shock and centrifugal force. As a result, the toner grains T sandwiched between the brush chains of the magnet brush are released and become free toner grains T' in the form of a cloud or smoke.

As shown in FIG. 18B, the free toner grains T' are attracted toward the latent image ML present on the drum 1 due to the electric field, developing the latent image ML. In the non-image portion of the drum 1, the electric field is directed from the drum 1 toward the sleeve 111*a* and causes the free toner grains T' to return to the carrier grains c on the sleeve 111*a* or to the sleeve 111*a*. This successfully enhances efficient use of the toner grains T and protects the inside of the apparatus from smearing ascribable to the toner grains T. The alternating electric field shown in FIG. 11 is applied to the gap between the drum 1 and the sleeve 111*a*.

Because the magnet brush contacts the drum 1 in the middle portion B and hind portion C of the developing zone, an electrode effect acts between the carrier grains c on the tips of the brush chains, i.e., adjacent the drum 1 and the drum 1. The electrode effect not only further uniforms the toner layer in the image portion, but also efficiently scavenges the toner grains T present on the background. This is also true when the bias is implemented as a DC bias. Moreover, the magnet brush contacts the drum 1 over a shorter period of time than in the conventional developing system, obviating direction-dependent defects including thinning of horizontal lines and the omission of the trailing edge of an image.

As shown in FIG. 18C, the toner grains move back and forth, i.e., oscillate between the carrier grains c on the tips of the brush chains and the drum 1 due to the alternating electric field and contact development, as indicated by a saw-tooth line. Such oscillation of the toner grains T further uniforms the toner layer in the image portion to thereby enhance dot reproducibility, while scavenging the toner grains T present in the non-image portion.

The carrier grains c used for the specific mode of development had a mean grain size of 50 μm and the strength of magnetization of 60 emu/g. Also, the toner grains T had a mean grain size of 7 μm, a concentration of 7 wt %, and an amount of charge of −25.5 μC/g. The linear velocity ratio of the sleeve 111*a* to the drum 1 was selected to be 1.4. The drum 1 was charged such that the potential was initially −700 V, −100 V in the image portion, and −650 V in the non-image portion. The alternating electric field consisted of a DC component of −500 V and an AC component with a peak-to-peak voltage of 1,000 V and a frequency of 2 kH and superposed on the DC component. Experiments showed that under the above conditions a high-quality image free from granularity in a half tone portion and having high image quality in a solid portion and sharp lines and characters was achievable.

[2-5] Development without Brush Chains Contacting Drum in Portions A through C

Development to be described is such that in the middle portion B and hind portion C of the developing zone, the brush chains risen on the sleeve 111*a* along the magnetic line of force in the fore portion A do not strongly contact the drum 1, but remain spaced from the drum 1. That is, the brush chains do not contact the drum 1 in any one of the consecutive zones A through C. This can be done if the gap between the sleeve 111*a* and the drum 1 is adjusted or if the strength of the main magnetic force distribution P1 is adjusted.

Development to occur in the fore portion A is the same as in [2-1] stated earlier. In the middle portion B and hind portion C, the magnetic poles P1 through P5 remain stationary relative to the rotating sleeve 111*a*, causing the carrier grains c to move. The relative displacement of the carrier grains c produces more free toner grains T' in accordance with the behavior described in [2-1]. Further, because the carrier grains c on the sleeve 111*a* are dielectric, a further enhanced electric field is formed between the drum 1 and the brush chains of the carrier grains c, causing the toner grains T to part from the carrier grains c and move toward the drum 1.

As stated above, while the brush chains on the sleeve 111*a* are spaced from the drum 1, the free toner grains T' parted from the carrier grains c in the fore portion A deposit on the drum 1. In the middle portion B and hind portion C, the tips of the brush chains move in the vicinity of the drum 1 with-the toner grains T on the carrier grains c parting from the carrier grains c. Despite that the tips of the brush chains move in the vicinity of the drum 1, they do not remove the toner grains T deposited on the drum 1 in the fore portion A, so that high image quality is insured.

[2-5-1] Development with Peak of Magnetic Force Shifted

In this developing method, the peak of the magnetic force may be shifted in the same manner as described in [2-4-1].

[2-5-2] EXAMPLE 2

Figure 19A:
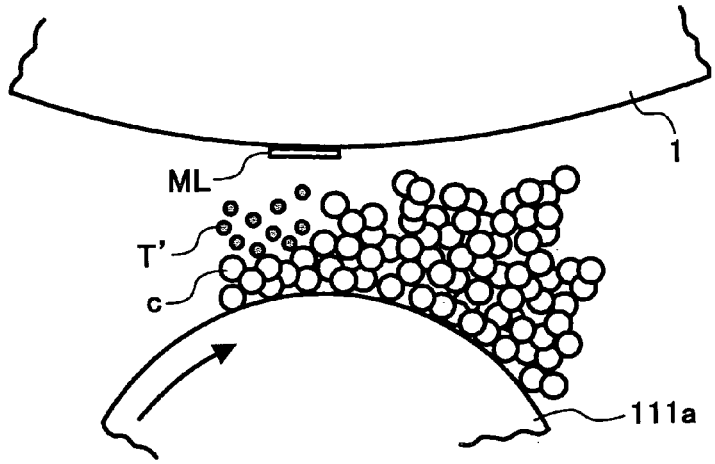
FIGS. 19A through 19C are sketches demonstrating consecutive developing stages in which the brush chains are constantly spaced from the image carrier.
Figure 19B:
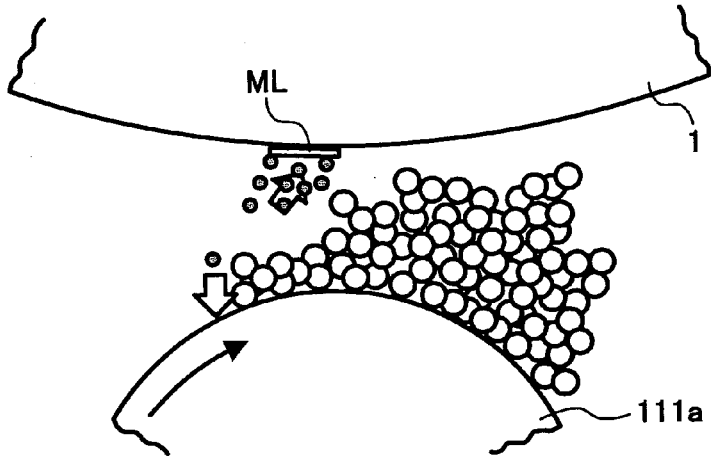
Figure 19C:
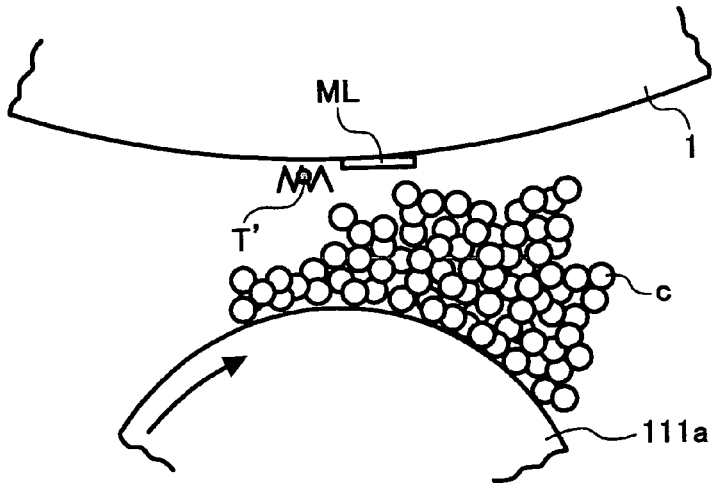

Example 2 is identical with Example 1 as to the configuration of the image forming apparatus except that to maintain the magnet brush spaced from the drum 1, the gap for development was selected to be 0.8 mm while the DC component of the electric field was selected to be −630 V. FIGS. 19A through 19C demonstrate the development of a latent image ML effected by the toner grains T in the developing zone.

As shown in FIG. 19A, in the fore portion A where the magnet brush having been pressed against the sleeve 111*a* starts rising, a space that allows the toner grains T to move around is formed in the magnet brush due to the shock and centrifugal force. As a result, the toner grains T sandwiched between the brush chains of the magnet brush are released and become free toner grains T' in the form of a cloud or smoke.

As shown in FIG. 19B, the free toner grains T' are attracted toward the latent image ML present on the drum 1 due to the electric field, developing the latent image ML. In the non-image portion of the drum 1, the electric field is directed from the drum 1 toward the sleeve 111*a* and causes the free toner grains T' to return to the carrier grains c on the sleeve 111*a* or to the sleeve 111*a*. This successfully enhances efficient use of the toner grains T and protects the inside of the apparatus from smearing ascribable to the toner grains T. The alternating electric field shown in FIG. 11 is applied to the gap between the drum 1 and the sleeve 111*a*.

As shown in FIG. 18C, the toner grains move back and forth, i.e., oscillate between the carrier grains c on the tips of the brush chains and the drum 1 due to the alternating electric field and contact development, as indicated by a saw-tooth line. Such oscillation of the toner grains T further uniforms the toner layer in the image portion to thereby enhance dot reproducibility, while scavenging the toner grains T present in the non-image portion.

[3] Developer

[3-1] Composition and Production of Toner

Toner applicable to the illustrative embodiment will be described hereinafter. In the illustrative embodiment, the toner T contains 1 part to 15 parts by weight, preferably 2 parts to 10 parts by weight, of parting agent for 100 parts by weight of binder resin. The parting agent content of the toner T less than 1 parts by weight cannot sufficiently obviate the offset of the toner grains T to a fixing roller. A parting agent content above 15 parts by weight lowers the developing ability, renders an image defective due to cohered toner, and lowers image transferability and durability. By confining the parting agent content in the range of from 2 parts by weight to 10 parts by weight, it is possible to form a high-quality image having high image density in a solid portion, a smooth solid portion and faithful dot reproduction.

For the parting agent, use may be made of any one of conventional substances including low molecular weight polyethylene, low molecular weight polypropylene and other low molecular weight polyolefinic waxes, Fischer-Tropsch wax and other synthetic hydrocarbonic waxes, beewax, carnauba wax, candelilla wax, rice wax, montan wax and other natural waxes, paraffin wax, micro-crystalline wax and other petroleum waxes, stearic acid, palmitic acid, myristic acid and other higher fatty acids and metallic salts of higher fatty acid, higher fatty acid amide, synthetic ester-based wax, and various modified waxes thereof.

Such parting agents may be used either singly or in combination. Among them, carnauba wax and synthetic ester-based wax are desirable from the parting ability standpoint.

In the illustrative embodiment, the additives should preferably be added to the toner grains T by an amount of 0.6 parts by weight to 4.0 parts by weight, more preferably 1.0 parts by weight to 3.6 parts by weight, for 100 parts by weight of the matrix particles. An amount of additives less than 0.6 parts by weight lowers fluidity of the toner and aggravates the cohesion of the toner grains. This not only makes the charge short due to short contact with the carrier grains c, but also renders image transferability and heat resistance short and brings about background contamination and toner scattering. On the other hand, an amount of additives above 4.0 parts by weight improves fluidity, but is apt to bring about chattering, turn-up of a blade and other drum cleaning defects as well filming on the drum 1 ascribable to the additives separated from the toner, thereby lowering durability of the cleaning blade and drum as well as the fixing ability.

By selecting the additive content of the toner grains T between 0.4 parts by weight and 4.0 parts by weight, more preferably between 1.0 parts by weight and 3.6 parts by weight, it is possible to guarantee a high-quality image having high image density in a solid portion and desirable reproducibility of a solid portion and dots.

For the additive, use may be may of any one of conventional substances including oxides or compound oxides of Si, Ti, Al, Mg, Ca, Sr, Ba, In, Ga, Ni, Mn, W, Fe, Co, Zn, Cr, Mo, Cu, Ag, V and Zr. Particularly, one or more of silica, titania and alumina, which are oxides of Si, Ti and Al, are desirable.

While various methods are available for measuring the content of the additives, an fluorescent X-ray analyzing method is most popular. The fluorescent X-ray analyzing method prepares a calibration curve with toner whose additive content is known beforehand, and the determines an additive content by using the calibration curve.

Further, it is preferable to treat the surface of the additive for providing it with hydrophobicity, improving fluidity, and controlling electrification. Organic silane compounds are preferable for the surface treatment. For example, use may be made of methyltrichlorosilane, octyl trichlorosilane, dimethyl dichlorosilane or similar alkylchlorosilane, dimethyl dimethoxysilane, octyl trimethoxysilane or similar alkyl methoxysilane, hexamethyldisilane or silicone oil.

Methods for surface treatment include one that dips the additive in a solution containing an organic silane compound and then drying it, and one that sprays the above solution on the additive and then drying it. Any one of such methods is advantageously applicable to the illustrative embodiment.

The grain size of the additive added to the matrix grains is preferably 0.002 μm to 0.2 μm in mean primary grain size from the fluidity standpoint, more preferably 0.005 μm to 0.05 μm.

An additive with a mean primary grain size less than 0.002 μm easily coheres, lacks sufficient fluidity, and easily causes filming to occur on the photoreceptor because such an additive is easily buried in the surfaces of the matrix grains. Further, when the means primary grain size is less than 0.002 μm, the additive grains are apt to cohere and make fluidity short. An additive with a mean primary grain size larger than 0.2 μm makes electrification insufficient and thereby brings about background contamination and toner scattering because fluidity is lowered. An additive with a mean primary grain size larger than 0.1 μm is likely to damage the surface of the drum 1 and causes filming to easily occur. The grain size of the additive can be measured by use of a transmission electron microscope.

The toner is composed of the matrix grains consisting of the binder resin, which contains the colorant, charge controlling agent and parting agent, and the additives deposited on the surfaces of the matrix grains.

The binder resin of the toner may be implemented by any one of conventionally binder resins including polystyrene, styrene-butadiene copolymer, styrene-polyvinyl chloride copolymer, styrene-acrylic ester copolymer, styrene-methacrylic ester copolymer, acrylic resin, polyester resin, epoxy resin, polyol resin, rosin-modified maleic acid resin, phenol resin, low molecular weight polyethylene, low molecular weight polypropylene, aionomer resin, polyurethane resin, ketone resin, ethylene-ethylacrylate copolymer, polybutylar, and silicone resin. These resins may be used either singly or in combination. Particularly, polyester resin and polyol resin are preferable.

By using polyester resin or polyol resin as the binder resin, it is possible to reduce the offset of the toner to the fixing device for thereby enhancing image transferability and safety charging, and to reduce cohered toner that would bring about local omission of an image.

Figure 20:
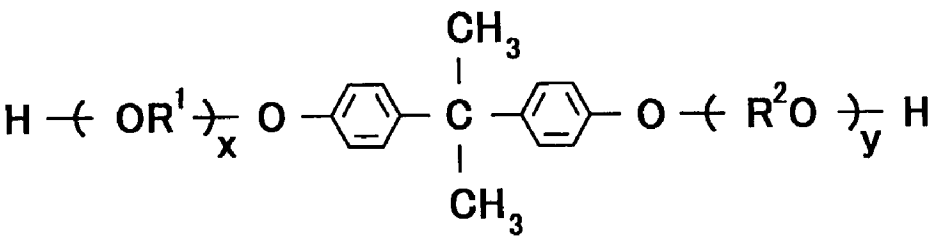
FIG. 20 shows a general formula 1.

While various types of polyester resins are usable, use should preferably be made of one produced by reacting the following substance:

(1) at least one of bihydric carboxylic acid and its lower alkylester and acid anhydride;

(2) diol component expressed by general formula 1 shown in FIG. 20 (in formula 1, $R^1$ and $R^2$ may be the same or different 2–4C alkylene group, x and y are repeating units and is 1 or above each, and x+y=2–16); or (3) at least one of tri- or higher polyhydric carboxylic acid and its lower alkylester and acid anhydride and tri- or higher polyhydric alcohol.

Examples of the above substance (1) are terephthalic acid, isophthalic acid, sebacic acid, isodecyl succinic acid, maleic acid, fumaric acid, and monomethylate, monoethylate, dimethylate, and diethylate of these acids. Particularly, terephthalic acid, isophthalic acid and dimethylesters thereof are preferable from the anti-blocking and cost standpoint.

These bihydric carboxylic acids, its lower alkylester and acid anhydride have critical influence on the fixing ability as well as anti-blocking property of the toner. More specifically, when aromatic terephthalic acid or isophthalic acid is used in a great amount, the anti-blocking property is enhanced, but the fixing ability is lowered, depending on the degree of condensation. On the contrary, when sebacic acid, isodecyl succinic acid, maleic acid or fumaric acid is used in a great amount, the fixing ability is enhanced, but the anti-blocking property is lowered. In light of this, these bihydric carboxylic acids are adequately selected in accordance with the composition, ratio and degree of condensation of the other monomers, and are used either singly or in combination.

For the diol component represented by the general formula 1 in the item (2), use may be made of polyoxypropylene-(n)-polyoxyethylene-(n')-2,2-bis(4-hydroxyphenyl) propane, polyoxypropylene-(n)-2,2-bis(4-hydroxyphenyl) propane or polyoxyethylene-(n)-2,2-bis(4-hydrophenyl) propane. Particularly, polyoxypropylene-(n)-2,2-bis(4-hydroxyphenyl)propane with $2.1 \leqq n \leqq 2.5$ or polyoxyethylene-(n)-2,2-bis(4-hydroxyphenyl)propane with $2.0 \leqq n \leqq 2.5$ is preferable because such a diol component raises the glass transition temperature and facilitates reaction control.

Alternatively, for the diol component, use may be made of aliphatic diols including ethylene glycol, diethylene glycol, 1,2-butanediol, 1,3-butanediol, 1,4-butanediol, neopentyl glycol and propylene glycol.

As for the tri- or higher polyhydric carboxylic acid or its lower alkylester or acid anhydride in the item (3), there may be used any one of 1,2,4-benzene-tricarboxylic acid (trimellitic acid), 1,3,5-benzenetricarboxylic acid, 1,2,4-cyclohexane-tricarboxylic acid, 2,5,7-naphthalenetricarboxylic acid, 1,2,4-naphthalenetricarboxylic acid, 1,2,4-butanetricarboxylic acid, 1,2,5-hexatricarboxylic acid, 1,3-dicarboxyl-2-methyl-2-methylenecarboxypropane, tetra(methylenecarboxy)methane, 1,2,7,8-octanetetracarboxylic acid, Empoltrimeracid, and monomethylate, monoethylate, dimethylate and diethylate thereof.

As for trihydric or higher polyhydric alcohol in the item (3), use may be made of any one of sorbitol, 1,2,3,6-hexane tetrol, 1,4-sorbitan, pentaerythritol, dipentaerythritol, tripentaerythritol, sucrose, 1,2,4-butanetriol, 1,2,5-pentatriol, glycerol, diglycerol, 2-methlypropanetriol, 2-methyl-1,2,4-butanetriol, trimethylolethane, trimethylolpropane, and 1,3,5-trihydroxymethylbenzene.

The blending ratio of tri- or higher multiple monomers should preferably be between 1 molar % and 30 molar % of the total monomer compositions. A blending ratio of 1 molar % or less lowers the anti-offset property of the toner and is apt to deteriorate durability. A blending ratio of higher than 30 molar % is apt to deteriorate the fixing ability.

Among the tri- or higher multiple monomers mentioned above, benzenetricarboxylic acids and anhydrides or esters thereof are particularly desirable because benzenetricarboxylic acids implement both of the fixing ability and anti-offset property Various types of polyol resins are available, it is preferable to use a polyol resin produced by reacting (1) an epoxy resin, (2) an alkylene oxide additive of dihydric phenol or its glycydyl ether, (3) a compound containing in the molecule one active hydrogen atom reacting with an epoxy group or (4) a compound containing in the molecule two or more active hydrogen atoms reacting with the epoxy group.

The epoxy resin (1) mentioned above is obtained by bonding preferably bisphenol such as bisphenol A or bisphenol F with epichlorohydrin. Particularly, to obtain epoxy resin having stable fixing characteristic and gloss, two or more types of bisphenol A type epoxy resins with different number-mean molecular weights are desirable; the number-mean molecular weight of the low molecular weight component should preferably be between 360 and 2,000 while that of the high molecular weight component should preferably be between 3,000 and 10,000. Further, the low molecular weight component should preferably be between 20 wt % and 50 wt % while the high molecular weight component should preferably be between 5 wt % and 40 wt %. An excessive amount of low molecular weight component or the molecular weight lower than 360 is likely to make gloss excessive or reduces shelf life. An excessive amount of high molecular weight component or the molecular weight higher than 10,000 is apt to make gloss short or degrade fixing ability.

Figure 21:
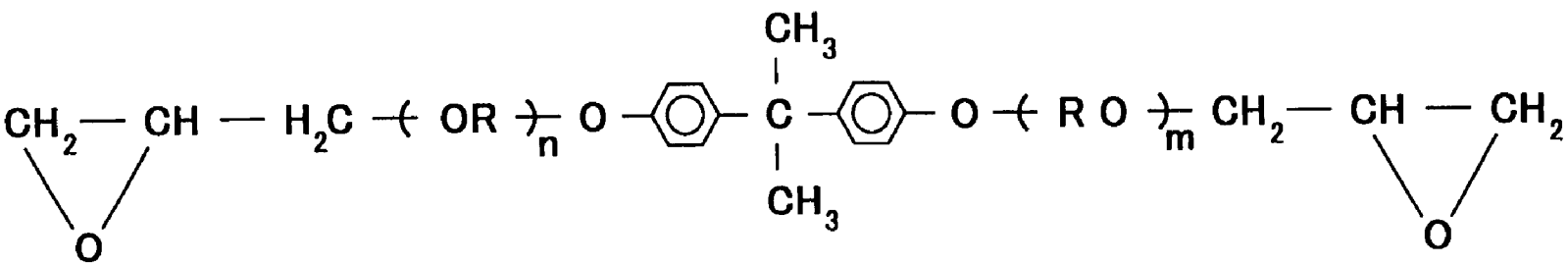
FIG. 21 shows a general formula 2.

The alkylene oxide additives of dihydric phenol of the compound (2) include reaction products of ethylene oxide, propylene oxide, butylene oxide and mixtures thereof with bisphenol A or bisphenol F. The obtained additive may be used by glycidylizing using epichlorohyd in or β-methylepichlorohydrin. Particularly, diglycidyl ether of the alkylene oxide additive of bisphenol A expressed by a formula 2 shown in FIG.21 is preferable. In the formula 2, R is a $—CH_2—CH_2—$, $—CH_2—CH(CH_3)—$, or $—CH_2—CH_2—CH_2—$ group; n and m are repeating units and are 1 or above each, and $n+m=2–6$.

10 wt % to 40 wt % of the alkylene oxide additive of dihydric phenol or its glycidyl ether should preferably be contained in relation to the polyol resin. A less content aggravates curling or brings about other defects while $n+m>7$ or an excessive content makes gloss excessive or reduces shelf life.

The compound (3) having in the molecule one active hydrogen atom reacting with the epoxy group may be any one of monohydric phenols, secondary amines and carboxylic acids. Monohydric phenols include phenol, cresol, isopropyl phenol, aminophenol, nonyl phenol, dodecyl phenol, xylenol, and p-cumyl phenol. Secondary amines include diethylamine, dipropylamine, dibutylamine, N-methyl (ethyl)piperazine, and piperidine. Carboxylic acids include propionic acid and caproic acid.

The compound (4) having in the molecule two or more active hydrogen atoms reacting with the epoxy group may be any one of dihydric phenols, polyhydric phenols, and polyhydric carboxylic acids. Dihydric phenols include bisphenol A and bisphenol F. Polyhydric phenols include orthocresol novolaks, phenol novolaks, tris(4-hydroxyphenyl)methane, and 1-[α-methyl-α-(4-hydroxyphenyl)ethyl] benzene. Polyhydric carboxylic acids include malonic acid, succinic acid, glutaric acid,adipic acid, maleic acid, fumaric acid, phthalic acid, terephthalic acid, trimellitic acid, and trimellitic anhydride.

The polyester resins and polyol resins mentioned above deteriorate transparency and gloss if crosslinking density is high, so that they should preferably be of non-crosslinking type or of low crosslinking type (with less than 5% of the insoluble portion).

The production methods of the binder resins stated above are only illustrative. Any of bulk polymerization, solution polymerization, emulsion polymerization and suspension polymerization may be used for the production.

As for the colorants, any one of conventional dyes and pigments may be used. Yellow coloring agents include Naphthol Yellow S, Hansa Yellow (10G, 5G, G), Cadmium Yellow, yellow iron oxide, ocher, Chrome Yellow, Titanium Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, Benzimidazolone Yellow, and Isoindolinone Yellow.

Red coloring agents include Red Oxide, minium, red lead, Cadmium Red, Cadmium Mercury Red, Antimony Vermilion, Permanent Red 4R, Para Red, Fire Red, parachloro-ortho-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red (F5R, FBB), Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, hodamine Lake Y, Aizarin Lake, Thioindigo Red B, Thioindigo Maroon, Oil Red, Quinacridone Red, Pyrazolone Red, Polyazo Red, Chrome Vermilion, Benzidine Orange, Perinone Orange, and Oil Orange.

Blue coloring agents include Cobalt Blue, Cerulean Blue, Alkali Blue Lake, Peacock Blue Lake, Victoria Blue Lake, metal-free Phthalocyanine Blue, Phthalocyanine Blue, Fast Sky Blue, Indanthrene Blue (RS,BC), indigo, Ultramarine, Berlin Blue, Anthraquinone Blue, Fast Violet B, Methyl Violet Lake, Cobalt Violet, Manganese Violet, Dioxane Violet, Anthraquinone Violet, Chrome Green, Zinc Green, chrome oxide, pyridian, Emerald Green, Pigment Green B, Naphtol Green B, Green Gold, Acid Green Lake, Malachite Green Lake, Phthalocyanine Green, and Anthraquinone Green.

Black coloring agents include azine-based coloring matters, such as, carbon black, oil furnace black, channel black, lamp black, acetylene black or aniline black, metallic salt azo coloring matters, metallic oxides, and compound metallic oxides. Other colorants include titania, zinc white, lithopone, nigrosine dye, and iron black The colorants stated above may be used either singly or in combination. The colorant content is usually 1 part by weight to 30 parts by weight, preferably 3 parts by weight to 20 parts by weight, for 100 parts by weight of the binder resin.

Other materials including an electrification control agent may be added to the toner used in the illustrative embodiment, if desired. There may be used any one of conventional electrification control agents including nigrosine dyes, chrome-containing complexes, and quaternary ammonium salt. These agents are selectively used in accordance with the polarity of the toner grains. Particularly, in the case of color toner, a colorless or a lightly colored agent having no influence on the tone of the toner is preferable, such as metallic salicylates or metallic salt of salicylic acid derivatives (Bontron E84 (trade name) available from Orient Co., Ltd. These electrification control agents may be used either singly or in combination. The content is usually between 0.5 part by weight and 8 parts by weight, preferably between 1 part by weight and 5 parts by weight, for 100 parts by weight of the binder resin.

A specific procedure available for the production of the toner will be described hereinafter. First, The binder resin and colorant with or without the electrification control agent, parting agent and magnetic grains are sufficiently mixed by a Henshel mixer or similar mixer. The resulting mixture is sufficiently kneaded by, e.g., a batch type double roll, a Banbury mixer, a biaxial extruder or a continuous monoaxial kneader. The kneaded mixture is coarsely pulverized by, e.g., a hammer mill, finely pulverized by a pulverizer using a jet stream or a mechanical pulverizer, and then sieved to a preselected grain size, thereby producing matrix toner grains.

Alternatively, use may be made of polymerization or encapsulation for the production of the toner. Polymerization is implemented by the steps of granulating a polymerizable monomer with or without a polymerization starting agent and a colorant in an aqueous dispersant, sieving the resulting monomer grains to a preslected size, polymerizing the grains with the preselected size, removing the dispersant by suitable processing, and then filtering, rinsing and drying the grains to produce matrix grains. Encapsulation is implemented by the steps of kneading a resin with or without a colorant to produce a molten core material, strongly agitating the core material in water to thereby prepare core grains, agitating the core grains in an shell solution while dropping a bad solvent to thereby encapsulate the core grains with the shell material, and then filtering and drying the resulting capsules to thereby produce matrix grains.

Subsequently, the matrix grains produced by any one of the specific methods stated above and additives are sufficiently kneaded by a suitable kneader and, if necessary, passed through a sieve with a mesh size of about 150 μm in order to remove cohered matters and coarse grains.

Other additives that may be added to the toner of the illustrative embodiment include a lubricant, e.g., Teflon, zinc stearate or vinylidene stearate, an abrasive, e.g., cerium oxide, silicon carbide or strontium titanate, and a conduction agent, e.g., zinc oxide, antimony oxide or tin oxide.

In the illustrative embodiment, the grain size of the toner should preferably between 4 μm and 9 μm, more preferably between 5 μm and 6 μm. A grain size smaller than 4 μm is apt to cause the toner to smear the background or fly about during development or apt to lower the fluidity of the toner and thereby obstruct toner replenishment and cleaning. A grain size greater than 8 μm is apt to cause the toner to be scattered in an image or apt to lower resolution. This program is particularly serious in the case of color images.

The carrier grains may be implemented by any conventional magnetic powder, e.g., iron powder, ferrite powder or nickel powder or glass beads. In any case, the carrier grains should preferably be coated with, e.g., resin. The resin may be any one of polycarbon fluoride, polyvinyl fluoride, vinyl fluoride, polyvinylidene fluoride, phenol resin, polyacetal fluoride, acrylic resin or silicone resin. To form the resin layer on the individual carrier grain, use maybe made of spraying, dipping or similar conventional technology. The resin content should preferably be between 1 part by weight and 10 parts by weight for 100 parts by weight of carrier grains. The resin film should preferably be 0.02 μm to 2 μm thick, more preferably 0.1 μm to 0.6 μm thick. An excessively thick layer is apt to lower the fluidity of the carrier or the developer while an excessively thin layer is apt to be shaved off or otherwise effected by aging.

The mean grain size of the carrier grains is usually between 10 μm and 100 μm, preferably between 20 μm and 60 μm. As for mixture ratio, 0.5 part by weight to 10.0 parts by weight of toner grains should preferably be contained for 100 parts by weight of carrier grains.

The covering ratio of the individual carrier grain with the toner grains is produced by:

Eq. (1)

The above covering ratio should preferably be between 35% and 70%. If the covering ratio is less than 35%, then the number of toner grains present on the individual carrier grain is too small to implement the expected developing ability and thereby lower image quality or renders a halftone image rough, thereby lowering image quality. Further, such a low covering ratio intensifies the electric field acting on the carrier and is apt to cause the carrier grains to deposit on the drum 1. If the covering ratio is above 70%, then the many toner grains on the individual carrier grain lower electric adhesion between themselves and the carrier grain and fly away from the carrier grain, contaminating the inside of the apparatus. The covering ratio between 35% and 70% obviates the above problems and, in addition, allows a latent image to be faithfully developed.

[4] Drum

Figure 22A:
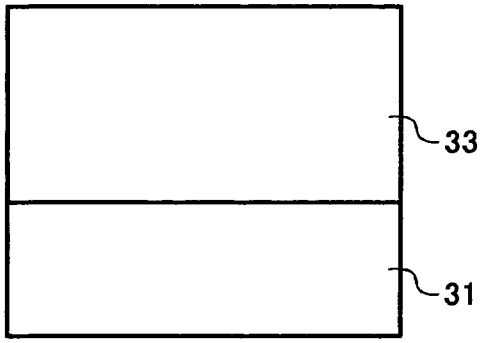
FIGS. 22A through 22D each show a specific configuration of the image carrier.

Specific configurations of the drum 1 included in the illustrative embodiment will be described with reference to FIGS. 22A through 22D. In FIG. 22A, the drum 1 is made up of a conductive base 31 and a single photoconductive layer 33 formed on the base 31 and consisting mainly of a charge generating substance and a charge transporting substance. The surface of the photoconductive layer 33 contains at least a filler.

Figure 22B:
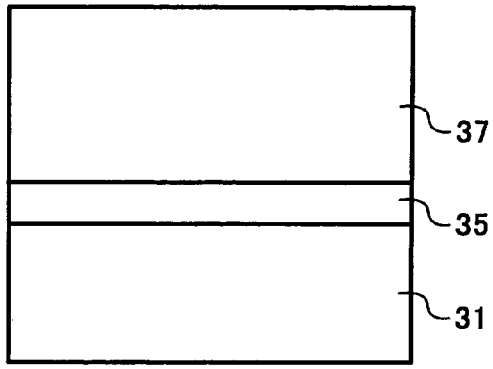

In FIG. 22B, the drum 1 is made up of the conductive base 31, a charge generating layer 35 formed on the base 31 and consisting mainly of a charge generating substance, and a charge transporting layer 37 formed on the charge generating layer 35 and consisting mainly of a charge transporting substance. The surface of the charge transporting layer 37 contains at least a filler.

Figure 22C:
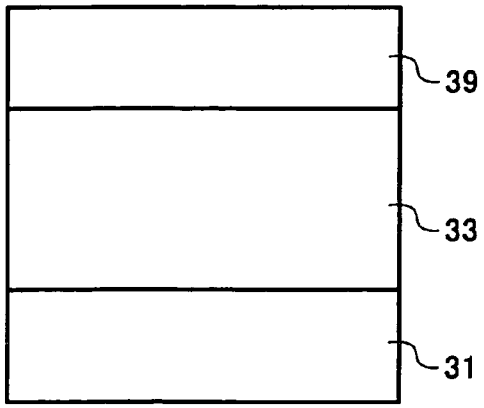

In FIG. 22C, the drum 1 is made up of the conductive base 31, the single photoconductive layer 33 formed on the base 31, and a filler-reinforced charge transporting layer 39 formed on the photoconductive layer 33 and containing a filler.

Figure 22D:
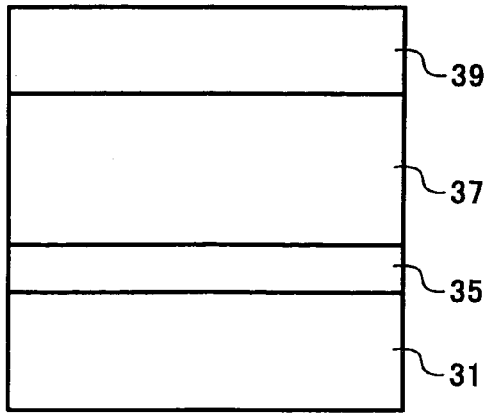

In FIG. 22D, the drum 1 is made up of the conductive base 31, the charge generating layer 35 formed on the base 31, the charge transporting layer 37 formed on the charge generating layer 35, and the filler-reinforced charge transporting layer 39 formed on the charge transporting layer 37 and containing a filler.

In any one of the configurations shown in FIGS. 22A through 22D, the conductive base 31 may be implemented as a film or a hollow cylinder formed of plastics or a paper coated with a material having conductivity of $10^{10}$ Ω·cm or below in terms of volume resistance, e.g., like or cylindrical plastic or paper coated with aluminum, nickel, chromium, nichrome, copper, gold, silver, platinum or similar metal or tin oxide, indium oxide or similar metal oxide by evaporation or spattering. Alternatively, use may be made of a plate of aluminum, aluminum alloy, nickel or stainless steel or a tube produced by extruding or drawing the plate and then subjected to surface treatment such as cutting, superfinishing or grinding. Further, an endless nickel belt or an endless stainless steel belt disclosed in Japanese Patent Laid-Open Publication No. 52-36016 may be used.

Also, the conductive base 31 may be implemented as one coated with conductive powder dispersed in a suitable binder resin. For the conductive powder, use may be made of anyone of carbon black, acetylene black, metallic powder of aluminum, nickel, iron, nichrome, copper, zinc or silver or conductive tin oxide powder or similar metallic oxide powder. The binder resin used in combination with the conductive powder may be thermoplastic, thermosetting or photo-setting resin, e.g., polystyrene, styrene-acrylonitrile copolymer, styrene-butadiene copolymer, styrene-maleic anhydride copolymer, polyester, polyvinyl chloride, vinyl chloride -vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin or alkyd resin. The conductive layer may be provided by dispersing these types of conductive powder and the binder resin in an appropriate solvent, e.g., tetrahydrofuran, dichloromethane, methyl ethyl ketone or toluene, and applying it to the condutive base.

The conductive layer may alternatively be implemented by a thermally contractive tube formed of, e.g., polyvinyl chloride, polypropylene, polyester, polystyrene, polyvinylidene chloride, polyethylene, chlorinated rubber or Teflon containing the conductive powder mentioned above.

As for the photoconductive layer of the illustrative embodiment, there may be used either of a monolayer type in which a charge generating material is dispersed in a charge transferring layer and a laminated type in which the electrical charge generating layer and charge transferring layer are laminated. First, the laminated type photoconductive layer implemented as the laminate of the charge generating layer 35 and charge transporting layer 37 will be described.

The charge generating layer 35 contains a charge generating material as a major component and may be implemented by a binder resin, as needed. For the charge generating material, use may be made of either one of an inorganic and an organic material.

The inorganic material may be any one of crystalline selenium, amorphous selenium, selenium-tellurium, selenium-tellurium-halogen, selenium-arsenic compounds and amorphous silicon. The amorphous silicon with a dangling bond terminated with hydrogen atoms or halogen atoms or doped with boron atoms or phosphorous atoms may advantageously be used.

For the organic material, there may be used any one of conventional materials, e.g., phthalocyanine-based pigments including metallic and metal-free phthalocyanine, an azulenium salt pigment, a squaric acid methin pigment, an azo pigment having a carbazole skeleton, an azo pigment having a triphenylamine skeleton, an azo pigment having a diphenylamine skeleton, an azo pigment having a dibenzothiophene skeleton, an azo pigment having fluorenone skeleton, an azo pigment having an oxadiazole skeleton, an azo pigment having a bisstilbene skeleton, an azo pigment having a distyryl oxadiazole skeleton, an azo pigment having a distyryl carbazole skeleton, a perylene-based pigment, an anthraquinone-based or polycyclic quinone-based pigment, a quinoneimine-based pigment, a diphenylmethane- and a triphenylmethane-based pigment, a benzoquinone- and a naphthoquinone-based pigment, a cyanine- and an azomethine-based pigment, an indigoid-based pigment, and a bisbenzimidazole-based pigment. These charge generating materials may be used either singly or in combination.

For the binder resin used for the charge generation layer 35 when necessary, there may be used polyamide, polyurethane, epoxy resin, polyketone, polycarbonate, polyarylate, silicone resin, acrylic resin, polyvinyl-butyral, polyvinyl formal, polyvinylketone, polystyrene, poly-N-vinylcarbazole or polyacrylamide either singly or in combination. Alternatively, there may be used a high molecular charge transferring material. Further, a low molecular charge transferring material may be added, if necessary.

The charge transporting materials applicable to the charge generating layer 35 are generally classified into electron transporting materials and hole transporting materials and are further classified low molecular type charge transporting materials and high molecular type charge transporting materials. In the following description, let the high molecular type charge transporting materials be referred to as high molecular charge transporting materials.

The charge transporting materials include electron receiving materials, e.g., chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-4H-indeno[1,2-b]thiophene-4-one, and 1,3,7-trinitrodibenzo-thiophene-5,5-dioxide. These electron transporting materials may be used either singly or in combination.

The hole transporting materials include electron donative materials, e.g., oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazones, α-phenylstilben derivatives, thiazole derivatives, triazole derivatives, phenazine derivatives, acridine derivatives, benzofuran derivatives, benzimidazole derivatives and thiophene derivatives. These hole transporting materials may be used either singly or in combination.

The high molecular charge transporting materials include polymers having carbazole ring, such as poly-N-vinylcarbazole, polymers having hydrazone structure taught in Japanese Patent Laid-Open Publication No. 57-78402, polysilylene polymers taught in Japanese Patent Laid-Open Publication No. 63-285552, and polymers having triarylamine structure taught in Japanese Patent Laid-Open Publication No. 7-325409. These high polymer charge transporting materials may be used either singly or in combination.

While the charge generating layer 35 consists mainly of the charge generating material, solvent and binder resin, it may additionally contain a sensitizer, a disperser, a surfactant and/or silicone oil.

Typical methods of forming the charge generating layer 35 are a vacuum thin-film producing method and a casting method from a solution dispersion system. The vacuum thin-film producing method may be any one of vacuum evaporation, glow discharge decomposition, ion plating, sputtering, reactive sputtering, CVD (Chemical Vapor Deposition), which can desirably form the inorganic and organic materials.

To form the charge generating layer 35 by the casing method, there may be executed the steps of dispersing the inorganic or organic charge generating material with or without the binder resin in tetrahydrofuran, cyclohexanone, dioxane, dichloroethane, butanone or similar solvent by use of a ball mill, an atriter or a sand mill, suitably diluting the dispersion liquid, and coating the diluted liquid by use of dipping, spray coating or bead coating.

The thickness of the charge generating layer 35 formed by the above procedure should preferably be 0.01 μm to 5 μm, more preferably 0.05 μm to 2 μm.

Hereinafter will be described the charge transporting layer 37. The charge transporting layer 37 may be formed by the steps of dispersing a mixture or a copolymer having the charge transporting component and the binder component as the main components in a suitable solvent, and coating and drying it. The thickness of the charge transporting layer 37 should preferably be 10 μm to 100 μm or 10 μm to 30 μm when high resolution is required.

In the illustrative embodiment, the high molecular compound that can be used as the binder component may be any one of thermoplastic or thermosetting resins including polystyrene, styrene/acrylonitrile copolymer, styrene/butadiene copolymer, styrene/maleic anhydride copolymer, polyester, polyvinyl chloride, vinyl chloride/vinyl acetate copolymer, polyvinyl acetate, polyvinylidene chloride, polyarlylate resin, polycarbonate, cellulose acetate resin, ethyl cellulose resin, polyvinyl butyral, polyvinyl formal, polyvinyl toluene, acrylic resin, silicone resin, fluorine resin, epoxy resin, melamine resin, urethane resin, phenol resin and alkyd resin. These high polymer compounds may be used either singly or in combination and may be copolymerized with the charge transporting material.

Materials usable for the charge transporting material include the low molecular type electron transporting materials, hole transporting materials and high molecular charge transporting materials mentioned earlier. When the low molecular type charge transporting material is used, the quantity used is 20 parts by weight to 200 parts by weight, preferably 50 parts by weight to 100 parts by weight, for 100 parts by weight of the high molecular compound. When the high molecular charge transporting material is used, a material with 0 part to 500 parts by weight of the resin component copolymerized for 100 parts by weight of the charge transporting component may advantageously be used.

The dispersion solvent used to prepare the liquid for coating the charge transporting layer may be any one of ketones including methyl ethyl ketone, acetone, methylisobutyl ketone and cyclohexanone, ethers including dioxane, tetrahydrofuran and ethyl cellosolve, aromatics including toluene and xylene, halogens including chlorobenzene and dichlorobenzene, and esters including ethyl acetate and butyl acetate.

When the filler-reinforced charge transporting layer 39, which will be described later, is absent, it is necessary to add a filler to at least the surface of the charge transporting layer 37 in order to enhance wear resistance. Organic fillers include polytetrafluoroethylene and other fluorocarbon resin powder, silicone resin powder, and a-carbon powder. Inorganic fillers include powder of copper, tin, aluminum, indium or similar metal, silica, tin oxide, zinc oxide, titanium oxide, alumina, indium oxide, antimony oxide, bismuth oxide, calcium oxide, tin oxide doped with antimony, indium oxide doped with tin or similar metallic oxide, tin fluoride, calcium fluoride, aluminum fluoride or similar metal fluoride, potassium titanate, and boron nitride.

Among the various fillers mentioned above, the inorganic material should advantageously be used from the hardness or wear resistance standpoint. Particularly, silica, titanium oxide or alumina is preferable. In any case, the filler has its surface treated with a surface treating agent in order to enhance dispersion in the coating liquid or the coated layer.

The filler may be dispersed by a disperser together with the charge transporting material, binder resin, and solvent. The primary mean grain size of the filler should preferably be between 0.01 μm and 0.8 μm in the aspect of transmittance and wear resistance of the charge transport layer.

The filler may be distributed in the entire charge transporting layer. However, considering a case wherein the potential in the exposed portion is high, it is preferable to distribute the filler such that the filler concentration is higher at the surface of the charge transporting layer than at the portion adjacent the conductive base or to implement the charge transporting layer as a laminate whose filler concentration sequentially increases toward the surface. The inorganic filler layer positioned at the surface of the charge transporting layer 37 has thickness, as measured from the surface, that should preferably be 0.5 μm or above, more specifically 2 μm or above.

When the filler-reinforced charge transporting layer 39 is present, the charge transporting layer 37 may be produced by the steps of dissolving or dispersing a mixture or a copolymer whose major components are a charge transporting component and a binder component in a suitable solvent, and coating and drying it. The charge transporting layer 37 should preferably be 10 μm to 100 μm thick or 10 μm to 30 μm when high resolution is required. In this case, the binder component for the charge transporting layer 37 may be the thermoplastic of the thermosetting resin mentioned earlier. Such high molecular compounds may be used either singly or in combination and may be copolymerized with the charge transporting material.

As for the charge transporting material, use may be made any one of the low molecular type charge transporting materials, hole transporting materials, and high molecular charge transporting materials stated earlier. A suitable antioxidant, plasticizer, lubricant, ultraviolet-absorptive agent or similar low molecular charge transporting material and a leveling agent may be added, if necessary. The content of the low molecular compound should preferably be 0.1 part by weight to 200 parts by weight, more preferably 0.1 part by weight to 30 parts by weight, for 100 parts by weight of the high molecular compound. The content of the leveling agent should preferably be 0.01 part by weight to 5 parts by weight for 100 parts by weight of the high molecular compound.

The filler-reinforced charge transporting layer 39 included in the illustrative embodiment will be described more specifically hereinafter. The filler-reinforced charge transporting layer 39 refers to a function layer containing at least a charge transporting component and a binder resin component and having both of a charge transporting ability and mechanical durability. The layer 39 has a charge migration degree as high as one achievable with the conventional charge transporting layer and is distinguished from a surface protection layer. The layer 39 constitutes a surface layer different from the charge transporting layer of a laminate photoconductive element in that the charge transporting layer is divided into two or more as to function. More specifically, the layer 39 is not used alone, but used in combination with the charge transporting layer not containing a filler in the form of a laminate. In this sense, the layer 39 is distinguished from a single charge transporting layer in which a filler is dispersed as an additive.

For the filler of the filler-reinforced charge transporting layer 39, use may advantageously be made of an inorganic material, particularly silica, titanium oxide or alumina, mentioned earlier in relation to the charge transport layer 37. One or more of such fillers may be used, as desired.

Again, the filler may have its surface treated with a surface treating agent in order to enhance dispersion in the coating liquid or the coated layer. The filler may be dispersed by a disperser together with the charge transporting material, binder resin, and solvent. The primary mean grain size of the filler should preferably be between 0.01 μm and 0.8 μm in the aspect of transmittance and wear resistance of the charge transport layer. The coating method may be any one of dipping, spraying, ring-coating, roll coating, photogravure coating, nozzle coating, and screen printing. The filler-reinforced transporting layer 39 should preferably be 0.5 μm thick or above, more preferably 2 μm thick or above.

As for the single photoconductive layer 33 formed on the conductive base 31 alone, the layer 33 may be formed by dissolving or dispersing a charge generating material, a charge transporting material and a binder resin in a suitable solvent, and then coating and drying it. A plasticizer, a leveling agent and an antioxidant may be added, as needed.

For the binder resin, use may be made not only of the binder resins mentioned in relation to the charge transporting layer 37, but of the binder resins mentioned in relation to the charge generating layer 35. The amount of the charge generating material should preferably be 5 parts by weight to 40 parts by weight for 100 parts by weight of the binder resin while the amount of the charge transporting material should preferably be 0 part by weight to 190 parts by weight, more preferably 50 parts by weight to 150 parts by weight, for 100 parts by weight of the binder resin. To form the single photoconductive layer 33, there maybe executed the steps of dispersing the charge generating material and binder resin in tetrahydrofulane, dioxane, dichloroethane, cyclohexane or similar solvent by a disperser together with the charge transporting material, and coating the resulting coating liquid by dipping, spray coating or bead coating. The layer 33 should preferably be 5 μm to 25 μm thick.

When a photoconductive layer forms the outermost surface, a filler must be contained in at least the surface of the photoconductive layer. Again, while the filler may be distributed in the entire photoconductive layer, it is preferable to set up a filler concentration slope or to form a laminate of photoconductive layers different in filler concentration.

In the drum 1 of the illustrative embodiment, an undercoat layer may be formed between the conductive base 31 and the photo conductive layer. Generally, the undercoat layer consists mainly of resin. Considering the fact that a photoconductive layer is to be coated on the resin by use of a solvent, the resin should preferably be highly resistant to organic solvents in general. Such resin may be any one of, e.g., polyvinyl alcohol, casein, sodium polyacrylate and other water-soluble resins, copolymerized nylo, methoxymethylated nylon and other alcohol-soluble resins, and polyurethane resin, melamine resin, phenol resin, alkyd-melamine resin, epoxy resin and other curable resins forming a tridimensional mesh structure. A fine powder pigment of a metallic oxide, e.g., titanium oxide, silica, alumina, zirconium oxide, tin oxide or indium oxide may be added to the undercoat layer in order to obviate moire and to reduce residual potential.

The undercoat layer may be formed by use of an appropriate solvent and coating method like the photoconductive layer. In the illustrative embodiment, for the under coat layer, a silane coupling agent, a titanium coupling agent or a chromium coupling agent may be used. Besides, use may be made of an undercoat layer provided with $Al_2O_3$ by anodic oxidation, provided with an organic substance, e.g., polyparaxylene (parilene) or provided with an inorganic substance by a vacuum thin layer producing method. The thickness of the undercoat layer should preferably be 0 μm to 20 μm, more preferably 1 μm to 10 μm.

In the illustrative embodiment, to improve resistance to environment, particularly to obviate a decrease in sensitivity and an increase in residual potential, an antioxidant, a plasticizer, a lubricant, an ultraviolet absorbent, a low molecular charge transferring material and a leveling agent may be added to the charge generating layers, charge transporting layers, undercoat layer, protection layer and intermediate layer. Typical of such compounds are given below.

The antioxidant applicable to each layer may be any one of the following although not limited thereto:

(a) Phenolic Compounds 2,6-di-t-butyl-p-clezole, butylated hydroxyanisol, 2,6-di-t-butyl-4-ethyl phenol, n-octadecyl-3-(4'-hydroxy-3',5'-di-t-butyl phenol), 2,2'-methylene-bis-(4-methyl-6-t-butyl phenol), 2,2'-methylene-bis-(4-ethyl-6-t-butyl phenol), 4,4'-thiobis-(3-methyl-6-t-butyl phenol), 4,4'-butyliden-bis-(3-methyl-6-t-butyl phenol), 1,1,3-tris-(2-methyl-4-hydroxy-5-t-butylphenyl)butane, 1,3,5-trimethyl-2,4,6-tris(3,5-di-butyl-4-hydroxybenzy1)benzene, tetrakis-[methylene-3-(3',5'-di-t-butyl-4'-hydroxyphenyl)propionate]methane, bis[3,3'-bis(4'-hydroxy-3'-t-butyl phenyl)butylic acid]glycol ester, and tocopherols (b) Paraphenylenediamines N-phenyl-N'-isopropyl-p-phenylenediamine, N,N'-di-sec-butyl-p-phenylenedimine, N-phenyl-N-sec-butyl-p-phenylenediamine, N,N'-di-isopropyl-p-phenylenediamine, and N,N'-dimethyl-N,N'-di-t-butyl-p-phenylenediamine (c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methyl hydroquinone, and 2-(2-octadecenyl)-5-methyl hydroquinone (d) Organic Sulfur Compounds dilauril-3,3'-thiodipropionate, distearyl-3,3'-thiodipropionate, and ditetradecyl-3,3'-thiodipropionate (e) Organic Phosphorus Compounds triphenyl phosphine, tri(nonyl phenyl)phosphine, tri(dinonyl phenyl)phosphine, tricresyl phosphine, and tri(2,4-dibutyl phenoxy)phosphine The plasticizers applicable to each layer are listed below, but not limited to:

(a) Phosphoric Ester-Based Plasticizer triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, and triphenyl phosphate (b) Phthalic Ester-Based Plasticizer dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diiosdecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumalate, and dioctyl fumalate (c) Aromatic Carboxylic Acid Ester-Based Plasticizer Trioctyl trimellitate, tri-n-octyl trimellitate, and octyl oxybenzoate (d) Aliphatic Dibasic Acid Ester-Based Plasticizer dibutyl adipate, di-n-hexyl adipate, di-2-ethylhexyl adipate, di-n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sabacate, di-2-ethoxyethyl sebacate, dioctyl succinate, diisodecyl succinate, dioctyl tetrahydrophthalate, and di-n-octyl tetrahydrophthalate (e) Aliphatic Ester Derivatives butyl oleate, glycerol mono-oleate, methyl acetylricinolate, pentaerythritol ester, dipentaerythritol hexa ester, triacetin, and tributyrin (f) Hydroxy Acid Ester-Based Plasticizer methyl acetylricinolate, butyl acetylricinolate, butylphthalyl butyl glycolate, and tributyl acetylcitrate (g) Epoxy Plasticizer epoxidized soyabean oil, epoxidized linseed oil, butyl epoxystearate, decyl epoxystearate, octyl epoxystearate, benzyl epoxystearate, dioctyl epoxyhexahydrophthalate, and didecyl epoxyhexahydrophthalate (h) Dihydric Alcoholic Ester-Based Plasticizer diethylene glycol dibenzoate and triethylene glycol di-2-ethylbutylate (i) Chlorine-Containing Plasticizer chlorinated paraffin, chlorinated diphenyl, chlorinated fatty methyl, and methoxy chlorinated fatty methyl (j) Polyester-Based Plasticizer polypropylene adipate, polypropylene sebacate, polyester, and acetylated polyester (k) Sulfonic Acid Derivatives p-Toluenesulfonamide, o-toluenesulfonamide, p-toluene ethylsulfonamide, o-toluene ethylsulfonamide, toluene sulfon-N-ethylamide, and p-toluene sulfon-N-cyclohexylamide (l) Citric Acid Derivatives triethyl citrate, acetyl triethyl citrate, tributyl citrate, acetyl tributyl citrate, acetyl-tri-2-ethylhexyl citrate, and acetyl-n-octyl decyl citrate (m) Others terphenyl, partially hydrogenated terphenyl, campher, 2-nitrodiphenyl, dinonyl naphthalene, and methyl abietate Lubricants applicable to each layer are listed below, but not limited to:

(a) Hydrocarbon Compounds liquid paraffin, paraffin wax, microwax, and low polymerized polyethylene (b) Fatty Acid-Based Compounds lauric acid, myristic acid, palmitic acid, stearic acid, arachidic acid, and behenic acid (c) Fatty Acid Amide-Based Compounds stearylamide, palmitylamide, oleic amide, methylene-bis-stearamide, and ethylene-bis-stearamide (d) Ester-Based Compounds lower alcohol ester of fatty acid, polyhydric alcohol ester of fatty acid, and fatty acid polyglycol ester (e) Alcoholic compounds cetyl alcohol, stearyl alcohol, ethylene glycol, polyethylene glycol, and polyglycerol (f) Metallic Soap L lead stearate, cadmium stearate, barium stearate, calcium stearate, zinc stearate, and magnesium stearate (g) Natural Wax carnauba wax, candelilla wax, beewax, whale wax, insect wax, and montan wax (h) Others silicone compounds and fluorine compounds The ultraviolet ray absorbent applicable to each layer are listed below, but not limited to:

(a) Benzophenones

2-Hydroxybenzophenone, 2,4-dihydroxybenzophenone, 2,2',4-trihydroxybenzophenone, 2,2',4,4'-tetrahydroxybenzophenone, and 2,2'-hydroxy-4-methoxybenzophenone (b) Salicylates phenyl salicylate and 2,4-di-t-butylphenyl-3,5-di-t-butyl-4-hydroxybenzoate (c) Benzotriazoles (2'-hydroxyphenyl)benzotriazole, (2'-hydroxy-5'-methylphenyl)benzotriazole, (2'-hydroxy-5'-methylphenyl)benzotriazole, and (2'-hydroxy3'-tertiarybutyl-5'-methylphenyl) 5-chlorobenzotriazole (d) Cyanoacrylates ethyl-2-cyano-3,3-diphenyl acrylate and methyl-2-carbomethoxy-3(paramethoxy)acrylate (e) Quencher (metallic complex salts)

nickel(2,2'thiosbis(4-t-octyl)phenolate)normal butylamine, nickel dibutyldithiocarbamate, and cobalt dicyclohexyldithiophosphate (F) HALS (hindered amines)

bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylprydine, 8-benzyl-7,7,9,9-tetramethyl-3-octyl-1,3,8-triazaspiro[4,5]undecan-2,4-dione, and 4-benzoiloxy-2,2,6,6-tetramethylpiperidine

[5] Image Forming Apparatus

A color image forming apparatus to which the illustrative embodiment also has the construction shown in FIG. 9 and will not be described specifically in order to avoid redundancy.

Various modifications will become possible for those skilled in the art after receiving the teachings of the present disclosure without departing from the scope thereof.

What is claimed is:

1. A method of developing a latent image formed on an image carrier having a photoconductive layer on a surface thereof with a developer including toner grains and magnetic carrier grains, said method comprising:

providing a developer carrier including a magnet, said developer carrier facing said image carrier to form a developing zone;

causing the developer to deposit on said developer carrier and move through said developing zone;

causing the carrier grains to gather and rise along magnetic lines of force of said magnet in a form of brush chains;

causing, when the carrier grains with the toner grains deposited thereon gather and rise in the form of brush chains, said toner grains to part from said carrier grains in accordance with relative displacement of said carrier grains and become free toner grains; and developing the latent image with said free toner grains wherein h is a height of the developer on the developer carrier at a zero point at which the magnetic force exerted on the developer by the magnet is zero, L is a distance between the zero point and the image carrier, and L/h is at least 1.5.

2. The method as claimed in claim 1, further comprising:

causing the carrier grains with the toner grains deposited thereon to move toward said developing zone in a mass together with said developer carrier; and producing the free toner grains in an initial stage of said developing zone.

3. The method as claimed in claim 1, further comprising:

forming in said developing zone an electric field that causes the free toner grains or the toner grains retained on the carrier grains to move toward said image carrier.

4. The method as claimed in claim 3, wherein the electric field comprises an alternating electric field.

5. The method as claimed in claim 1, wherein the toner grains contain binder resin comprising either one of polyester resin and polyol resin.

6. The method as claimed in claim 5, wherein the toner grains contain 2 parts by weight 10 parts by weight of a parting agent for 100 parts by weight of the binder resin.

7. The method as claimed in claim 6, wherein the parting agent comprises either one of camauba wax and synthetic ester-based wax.

8. The method as claimed in claim 6, wherein the toner grains contain 1.0 part by weight to 3.6 parts by weight of an additive for 100 parts by weight of a matrix comprising the parting agent and the binder resin.

9. The method as claimed in claim 8, wherein the additive has a mean primary grain size of 0.02 μm to 0.2 μm.

10. The method as claimed in claim 8, wherein the additive comprises at least one of silica, titania, and alumina.

11. The method as claimed in claim 1, wherein the toner grains cover 35% to 75% of a surface of an individual carrier grain.

12. A method of developing a latent image formed on an image carrier having a photoconductive layer on a surface thereof with a developer including toner grains and magnetic carrier grains, said method comprising:

providing a developer carrier including a magnet, said developer carrier facing said image carrier to form a developing zone;

causing the developer to deposit on said developer carrier and move through said developing zone;

causing the carrier grains to gather and rise along magnetic lines of force of said magnet in a form of brush chains;

causing the brush chains rising along the magnetic lines of force to contact said image carrier, the brush chains rising to cause the toner grains to part from the carrier grains in a form of free toner grains; and scattering the free toner grains onto said image carrier to develop the latent image, wherein h is a height of the developer on the developer carrier at a zero point at which the magnetic force exerted on the developer by the magnet is zero, L is a distance between the zero point and the image carrier, and L/h is at least 1.5.

13. The method as claimed in claim 12, further comprising:

forming in said developing zone an electric field that attracts the free toner grains or the toner grains retained on the carrier grains.

14. The method as claimed in claim 13, wherein the electric field comprises an alternating electric field.

15. The method as claimed in claim 12, wherein the toner grains contain binder resin comprising either one of polyester resin and polyol resin.

16. The method as claimed in claim 15, wherein the toner grains contain 2 parts by weight 10 parts by weight of a parting agent for 100 parts by weight of the binder resin.

17. The method as claimed in claim 16, wherein the parting agent comprises either one of carnauba wax and synthetic ester-based wax.

18. The method as claimed in claim 16, wherein the toner grains contain 1.0 part by weight to 3.6 parts by weight of an additive for 100 parts by weight of a matrix comprising the parting agent and the binder resin.

19. The method as claimed in claim 18, wherein the additive has a mean primary grain size of 0.02 μm to 0.2 μm.

20. The method as claimed in claim 18, wherein the additive comprises at least one of silica, titania, and alumina.

21. The method as claimed in claim 12, wherein the toner grains cover 35% to 75% of a surface of an individual carrier grain.

22. A method of developing a latent image formed on an image carrier having a photoconductive layer on a surface thereof with a developer including toner grains and magnetic carrier grains, said method comprising:

providing a developer carrier including a magnet, said developer carrier facing said image carrier to form a developing zone;

causing the developer to deposit on said developer carrier and move through said developing zone;

causing the carrier grains to gather and rise along magnetic lines of force of said magnet in a form of brush chains;

causing the brush chains to move with tips thereof contacting said image carrier;

developing an image portion forming the latent image by an electric field formed between said image carrier and said developer carrier and an electric field formed between said image carrier and the carrier grains; and returning the toner grains present on a non-image portion of said image carrier toward the carrier grains forming the brush chains, wherein h is a height of the developer on the developer carrier at a zero point at which the magnetic force exerted on the developer by the magnet is zero, L is a distance between the zero point and the image carrier, and L/h is at least 1.5.

23. The method as claimed in claim 22, further comprising:

forming in said developing zone an electric field that attracts free toner grains or the toner grains retained on the carrier grains.

24. The method as claimed in claim 23, wherein the electric field comprises an alternating electric field.

25. The method as claimed in claim 22, wherein the toner grains contain binder resin comprising either one of polyester resin and polyol resin.

26. The method as claimed in claim 25, wherein the toner grains contain 2 parts by weight 10 parts by weight of a parting agent for 100 parts by weight of the binder resin.

27. The method as claimed in claim 26, wherein the parting agent comprises either one of camauba wax and synthetic ester-based wax.

28. The method as claimed in claim 26, wherein the toner grains contain 1.0 part by weight to 3.6 parts by weight of an additive for 100 parts by weight of a matrix comprising the parting agent and the binder resin.

29. The method as claimed in claim 28, wherein the additive has a mean primary grain size of 0.02 μm to 0.2 μm.

30. The method as claimed in claim 28, wherein the additive comprises at least one of silica, titanic, and alumina.

31. The method as claimed in claim 22, wherein the toner grains cover 35% to 75% of a surface of an individual carrier grain.

32. A method of developing a latent image formed on a drum-shaped image carrier having a photoconductive layer on a surface thereof to produce a corresponding toner image, said method comprising:

providing a drum-shaped developer carrier including a magnet, said developer carrier facing said image carrier to form a developing zone between curved surfaces of the developer carrier and the image carrier that are facing each other, wherein said developing zone includes a middle portion including a position where said developer carrier and said image carrier are closest to each other, a fore portion upstream of said middle portion in a direction of movement of said image carrier, and a hind portion downstream of said middle portion in said direction;

depositing a developer including toner grains and magnetic carrier grains retaining said toner grains thereon on said developer carrier;

causing said developer carrier to be in rotation to convey said developer via said developing zone;

causing the developer to gather along magnetic lines of force of said magnet in a form of brush chains in said developing zone;

when the carrier grains gathering with the toner grains deposited thereon start rising in said fore portion along the magnetic lines of force, causing said toner grains to part from said carrier grains in accordance with relative displacement of said carrier grains and become free toner grains for developing the latent image;

contacting the brush chains risen in said fore portion with said image carrier in said middle portion, the brush chains releasing the toner grains, resulting in free toner grains being sprayed onto said image carrier for developing the latent image;

developing, at least in said hind portion, an image portion of the latent image by an electric field formed between said image carrier and said developer carrier and an electric field formed between said image carrier and the carrier grains; and returning, at least in said hind portion, the toner grains present in a non-image portion of said image carrier toward said carrier grains forming the brush chains;

wherein h is a height of the developer on the developer carrier at a zero point at which the magnetic force exerted on the developer by the magnet is zero, L is a distance between the zero point and the image carrier, and L/h is at least 1.5.

33. The method as claimed in claim 32, further comprising:

causing the brush chains risen in said fore portion to remain spaced from said image carrier in said middle portion without strongly contacting said image carrier; and developing the latent image with the free toner grains produced by the relative displacement of the carrier grains.

34. The method as claimed in claim 32, further comprising:

forming in said developing zone an electric field attracting the free toner grains or the toner grains retained on the carrier grains.

35. The method as claimed in claim 32, wherein the electric field comprises an alternating electric field.

36. The method as claimed in claim 35, wherein the toner grains contain binder resin comprising either one of polyester resin and polyol resin.

37. The method as claimed in claim 36, wherein the toner grains contain 2 parts by weight 10 parts by weight of a parting agent for 100 parts by weight of the binder resin.

38. The method as claimed in claim 37, wherein the parting agent comprises either one of carnauba wax and synthetic ester-based wax.

39. The method as claimed in claim 37, wherein the toner grains contain 1.0 part by weight to 3.6 parts by weight of an additive for 100 parts by weight of a matrix of the parting agent and the binder resin.

40. The method as claimed in claim 39, wherein the additive has a mean primary grain size of 0.02 μm to 0.2 μm.

41. The method as claimed in claim 39, wherein the additive comprises at least one of silica, titania, and alumina.

42. The method as claimed in claim 32, wherein the toner grains cover 35% to 75% of a surface of an individual carrier grain.

43. A developing device configured to develop a latent image formed on a drum-shaped image carrier having a photoconductive layer on a surface thereof to produce a corresponding toner image, comprising:

a drum-shaped developer carrier including a magnet, said developer carrier facing said image carrier to form a developing zone between curved surfaces of the developer carrier and the image carrier that are facing each other, said developer carrier configured to be deposited thereon with a developer including toner grains and magnetic carrier grains retaining said toner grains thereon, configured to be caused to be in rotation to convey said developer via said developing zone, and configured to cause the developer to gather along magnetic lines of force of said magnet in a form of brush chains in said developing zone, wherein said developing zone includes a middle portion including a position where said developer carrier and said image carrier are closest to each other, a fore portion upstream of said middle portion in a direction of movement of said image carrier, and a hind portion downstream of said middle portion in said direction, wherein when the carrier grains gathering with the toner grains deposited thereon start rising in said fore portion along the magnetic lines of force, said toner grains part from said carrier grains in accordance with relative displacement of said carrier grains and become free toner grains for developing the latent image, wherein the brush chains risen in said fore portion contact said image carrier in said middle portion, the brush chains release the toner grains, and resulting free toner grains are sprayed onto said image carrier for developing the latent image, wherein at least in said hind portion, an image portion of the latent image is developed by an electric field formed between said image carrier and said developer carrier and an electric field formed between said image carrier and the carrier grains, and the toner grains present in a non-image portion of said image carrier are turned toward said carrier grains forming the brush chains, and wherein h is a height of the developer on the developer carrier at a zero point at which the magnetic force exerted on the developer by the magnet is zero, L is a distance between the zero point and the image carrier, and L/h is at least 1.5.

44. The device as claimed in claim 43, wherein said image carrier comprises a conductive base and said photoconductive layer comprises either one of a single charge transporting layer with a charge generating material dispersed therein and a laminate of a charge generating layer and a charge transporting layer.

45. The device as claimed in claim 43, wherein a main magnetic force distribution P1 for development formed around said developer carrier has a peak position M1 in a direction normal to said developer carrier shifted from a position M0 where said image carrier and said developer carrier are closest to each other by 0° to 30° to a downstream side in the direction of movement of said image carrier.

46. An image forming apparatus comprising:

a drum-shaped image carrier having a photoconductive layer on a surface thereof a developing device configured to develop a latent image formed on said image carrier with a developer including toner grains and magnetic carrier grains retaining said toner grains thereon to form a toner image, said developing device including:

a drum-shaped developer carrier including a magnet and facing said image carrier to form a developing zone between curved surfaces of the developer carrier and the image carrier that are facing each other, said developer carrier configured to be deposited thereon with said developer, configured to be caused to be in rotation to convey said developer via said developing zone, and configured to cause the developer to gather along magnetic lines of force of said magnet in a form of brush chains in said developing zone;

a transfer device configured to transfer said toner image to a recording medium; and a fixing device configured to fix said toner image on said recording medium, wherein said developing zone includes a middle portion including a position where said developer carrier and said image carrier are closest to each other, a fore portion upstream of said middle portion in a direction of movement of said image carrier, and a hind portion downstream of said middle portion in said direction, wherein when the carrier grains gathering with the toner grains deposited thereon start rising in said fore portion along the magnetic lines of force, said toner grains part from said carrier grains in accordance with relative displacement of said carrier grains and become free toner grains for developing the latent image, wherein the brush chains risen in said fore portion strongly contact said image carrier in said middle portion, the brush chains release the toner grains, and resulting free toner grains are sprayed onto said image carrier for developing the latent image, wherein at least in said hind portion, an image portion of the latent image is developed by an electric field formed between said image carrier and said developer carrier and an electric field formed between said image carrier and the carrier grains, and the toner grains present in a non-image portion of said image carrier are turned toward said carrier grains forming the brush chains, and wherein h is a height of the developer on the developer carrier at a zero point at which the magnetic force exerted on the developer by the magnet is zero, L is a distance between the zero point and the image carrier, and L/h is at least 1.5.

* * * * *